US010136789B2

(12) United States Patent
Zohar et al.

(10) Patent No.: US 10,136,789 B2
(45) Date of Patent: Nov. 27, 2018

(54) ALL-IN-ONE SQUEEZABLE SCRUBBING TOOL

(71) Applicant: THE CLOROX COMPANY, Oakland, CA (US)

(72) Inventors: Hagar Zohar, Pleasanton, CA (US); Kerry D. Azelton, Pleasanton, CA (US); German R. Gonzalez, Pleasanton, CA (US); John E. Jamieson, Pleasanton, CA (US); Benjamin Ma, Pleasanton, CA (US); Jennifer A. Murphy, Oakland, CA (US); George S. Sieverding, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 134 days.

(21) Appl. No.: 15/097,077

(22) Filed: Apr. 12, 2016

(65) Prior Publication Data

US 2016/0220088 A1 Aug. 4, 2016

Related U.S. Application Data

(63) Continuation-in-part of application No. 14/876,700, filed on Oct. 6, 2015, now Pat. No. 10,071,399.
(Continued)

(51) Int. Cl.
*A47L 13/17* (2006.01)
*A47K 3/28* (2006.01)
*C11D 17/04* (2006.01)

(52) U.S. Cl.
CPC ..... *A47L 13/17* (2013.01); *A47K 3/281* (2013.01); *C11D 17/041* (2013.01); *C11D 17/049* (2013.01)

(58) Field of Classification Search
CPC ..... A47L 13/17; A47K 3/281; C11D 17/041; C11D 17/049
(Continued)

(56) References Cited

U.S. PATENT DOCUMENTS 41,700 A * 2/1864 Hamilton et al. . A46B 11/0013 401/278
D101,784 S 11/1936 Kurtz
(Continued)

FOREIGN PATENT DOCUMENTS

CA 2491170 A2 6/2006
EP 0198389 B1 1/1995
(Continued)

OTHER PUBLICATIONS

Notice of Allowance dated Dec. 7, 2017; U.S. Appl. No. 29/564,853, filed May 16, 2016.
(Continued)

*Primary Examiner* — David Walczak
(74) *Attorney, Agent, or Firm* — Alok Goel

(57) ABSTRACT

An all-in-one cleaning device, e.g., such as may be used in cleaning the inside of a shower. The device may provide the ability to dispense a cleaning composition carried within the device itself, and scrub the cleaning composition onto or into the surfaces to be cleaned (e.g., shower walls, floors, corners, mirrors, etc.). The device may include a squeezable container housing holding the cleaning composition in a reservoir defined therein, with a dispensing valve configured to dispense the cleaning composition from the reservoir, through the valve when a user squeezes the container housing. A sled may be provided, e.g., snap-fit to a bottom wall of the container housing, with a substrate configured as a scrubbing pad attached to the bottom of the sled.

14 Claims, 15 Drawing Sheets

Related U.S. Application Data

(60) Provisional application No. 62/060,457, filed on Oct. 6, 2014.

(58) Field of Classification Search
USPC ..... 401/188 R
See application file for complete search history.

(56) References Cited

U.S. PATENT DOCUMENTS 2,557,267 A * 6/1951 Ellinger ..... A46B 11/0013 15/176.1
2,827,650 A * 3/1958 Morrill ..... B65D 47/263 401/139
4,780,017 A * 10/1988 Bradford ..... A45D 34/045 401/123
D301,204 S 5/1989 Cramer
4,850,729 A * 7/1989 Kramer ..... A46B 11/0041 252/186.29
D321,930 S 11/1991 Dinand
D329,607 S 9/1992 Dinand
5,165,811 A * 11/1992 MacLeod ..... A47L 1/08 401/140
D344,231 S 2/1994 Gagnon
5,454,659 A 10/1995 Vosbikian et al.
D373,955 S 9/1996 Boxer
5,656,226 A 8/1997 McVicker
D395,598 S 6/1998 Van Lit et al.
D398,427 S 9/1998 Berti
D409,915 S 5/1999 Durliat et al.
5,915,869 A 6/1999 Agosto et al.
D439,053 S 3/2001 Hay
6,224,283 B1 * 5/2001 Hay ..... A46B 11/0013 222/213
D459,650 S 7/2002 Gagnon
6,425,701 B1 7/2002 Jacobs
D473,382 S 4/2003 Dutra
D477,917 S 8/2003 Giacolo et al.
6,682,246 B2 * 1/2004 Reggiani ..... B65D 83/285 401/183
6,685,376 B2 2/2004 Weihrauch
D496,202 S 9/2004 Hansen
D501,085 S 1/2005 Hay
6,842,936 B2 1/2005 Policicchio et al.
6,983,866 B2 1/2006 Smart
6,998,373 B1 2/2006 Faines, Jr. et al.
D524,546 S 7/2006 Ajluni et al.
7,131,902 B2 11/2006 Hope
7,264,414 B2 6/2007 McReynolds et al.
D556,408 S 11/2007 Lang et al.
D562,011 S 2/2008 Meyer
D564,353 S 3/2008 Ruiz De Gopegui et al.
D565,948 S 4/2008 Maas et al.
D569,723 S 5/2008 Sellick
D578,262 S 10/2008 Trotter et al.
D578,720 S 10/2008 Norcom et al.
D580,274 S 11/2008 Abel
7,446,082 B2 11/2008 Kilkenny et al.
D583,156 S 12/2008 Constantine
D583,566 S 12/2008 Meyer
7,470,652 B2 12/2008 Kilkenny et al.
7,536,743 B2 5/2009 Goh et al.
7,540,056 B2 6/2009 Dotterman et al.
7,553,221 B2 6/2009 Hope et al.
D602,779 S 10/2009 Buogo et al.
7,610,647 B2 11/2009 Morgan et al.
7,682,097 B2 3/2010 Knopow et al.
D617,198 S 6/2010 Lee et al.
7,837,403 B2 11/2010 Willinger et al.
D628,481 S 12/2010 Maddy
D632,587 S 2/2011 Richmond
D636,860 S 4/2011 Abbondanzio et al.
D640,850 S 6/2011 Koenig et al.
8,025,453 B2 9/2011 Chan
D650,290 S 12/2011 Natsume et al.
D653,540 S 2/2012 Sweeton
D653,947 S 2/2012 Arminak
D655,199 S 3/2012 Ciriani
D656,413 S 3/2012 Hayton et al.
D658,063 S 4/2012 Simmons
8,167,510 B2 5/2012 LaFlamme et al.
8,627,986 B2 1/2014 Bradbury
8,648,027 B2 2/2014 Mitchell et al.
8,684,619 B2 4/2014 Uchiyama et al.
D705,649 S 5/2014 Sweeton
8,763,616 B2 7/2014 Koptis et al.
8,834,055 B2 9/2014 Uchiyama et al.
D714,648 S 10/2014 Kersten
D717,666 S 11/2014 Palm et al.
8,888,395 B1 * 11/2014 Hinnant ..... A46B 5/0075 401/188 R
8,910,343 B2 12/2014 Huber et al.
9,044,852 B2 * 6/2015 Shafer ..... A46B 11/0017
D740,568 S 10/2015 Schafer et al.
D745,234 S 12/2015 Brown
D745,402 S 12/2015 Lovegrove
D764,309 S 8/2016 Yakos
D770,800 S 11/2016 Agarwal et al.
D805,391 S 12/2017 Azelton et al.
2003/0074756 A1 4/2003 Policicchio et al.
2003/0104962 A1 * 6/2003 Verherbrugghen ..... A47L 25/08 510/296
2004/0101347 A1 5/2004 Beard
2004/0117935 A1 6/2004 Cavalheiro
2004/0140326 A1 * 7/2004 Smart ..... A45D 34/042 222/192
2004/0265042 A1 * 12/2004 Chan ..... A46B 11/0055 401/270
2005/0039293 A1 2/2005 McReynolds et al.
2005/0069375 A1 * 3/2005 Kliegman ..... A46B 11/0013 401/278
2005/0155628 A1 7/2005 Kilkenny et al.
2005/0155631 A1 7/2005 Kilkenny et al.
2005/0229344 A1 10/2005 Mittelstaedt et al.
2006/0032944 A1 2/2006 Hornsby et al.
2006/0048318 A1 3/2006 Goh et al.
2006/0048319 A1 3/2006 Morgan et al.
2006/0133886 A1 6/2006 Willinger
2006/0154582 A1 7/2006 Hope
2006/0168748 A1 8/2006 Dotterman et al.
2006/0168750 A1 8/2006 Dotterman et al.
2006/0233592 A1 10/2006 Knopow
2007/0082591 A1 4/2007 Hope et al.
2007/0094827 A1 5/2007 Kilkenny
2007/0094829 A1 5/2007 Dotterman et al.
2007/0191252 A1 8/2007 Kilkenny et al.
2007/0191253 A1 8/2007 Kilkenny et al.
2008/0098546 A1 5/2008 Warmka et al.
2008/0115302 A1 5/2008 Kilkenny et al.
2008/0205965 A1 * 8/2008 LaFlamme ..... A45D 34/04 401/6
2008/0264972 A1 * 10/2008 LaFlamme ..... A45D 34/04 222/207
2008/0267689 A1 10/2008 Soller et al.
2008/0317389 A1 12/2008 Pung et al.
2009/0038092 A1 2/2009 Kennedy et al.
2009/0165228 A1 7/2009 Kilkenny et al.
2011/0243643 A1 10/2011 Huang
2012/0096662 A1 * 4/2012 Uchiyama ..... A46B 5/0058 15/160
2012/0301208 A1 * 11/2012 Hughes ..... A47L 13/12 401/137
2012/0301210 A1 11/2012 Sturgis et al.
2013/0043329 A1 * 2/2013 Bradbury ..... B65D 83/285 239/302
2013/0047358 A1 2/2013 Schafer et al.
2013/0047361 A1 2/2013 Meili et al.
2013/0047362 A1 2/2013 Steinhardt et al.
2013/0047363 A1 2/2013 Schafer et al.
2013/0340186 A1 12/2013 Uchiyama et al.
2014/0230847 A1 8/2014 Pung
2014/0259499 A1 9/2014 Post
2014/0259500 A1 9/2014 Post

(56) References Cited

U.S. PATENT DOCUMENTS

| | | | |
|---|---|---|---|
| 2014/0259501 | A1 | 9/2014 | Post |
| 2014/0265056 | A1 | 9/2014 | Kozak |
| 2014/0290695 | A1 | 10/2014 | Uchiyama et al. |
| 2015/0068371 | A1 | 3/2015 | Terrelonge |
| 2015/0121637 | A1 | 5/2015 | Brenner |
| 2015/0139721 | A1 | 5/2015 | Conway |
| 2015/0297045 | A1 | 10/2015 | Marsh |
| 2016/0096204 | A1 | 4/2016 | Perlas et al. |
| 2016/0199162 | A1 | 7/2016 | Brilliant |
| 2016/0220088 | A1 | 8/2016 | Zohar et al. |
| 2016/0235272 | A1 | 8/2016 | Azelton et al. |
| 2017/0172380 | A1 | 6/2017 | Sampaio |

FOREIGN PATENT DOCUMENTS

| | | | |
|---|---|---|---|
| WO | 0162122 | A2 | 8/2001 |
| WO | 2004020151 | A1 | 3/2004 |
| WO | 2010032105 | A1 | 3/2010 |
| WO | 2014143415 | A1 | 9/2014 |

OTHER PUBLICATIONS

Office Action dated Feb. 9, 2018; U.S. Appl. No. 14/876,700, filed Oct. 6, 2015.
Office Action dated Feb. 9, 2018; U.S. Appl. No. 15/138,052, filed Apr. 25, 2016.
Office Action dated Feb. 22, 2018; U.S. Appl. No. 29/564,854, filed May 16, 2016.

* cited by examiner

ALL-IN-ONE SQUEEZABLE SCRUBBING TOOL

CROSS-REFERENCE TO RELATED APPLICATIONS

The present application is a continuation in part of U.S. patent application Ser. No. 14/876,700, filed Oct. 6, 2015 and entitled "ARTICLES FOR SCRUBBING AND CLEANING HARD SURFACES AND A METHOD FOR USE THEREOF", which claims the benefit of U.S. patent application Ser. No. 62/060,457, filed Oct. 6, 2014 and entitled "ARTICLE FOR SCRUBBING AND CLEANING HARD SURFACES AND A METHOD FOR USE THEREOF", the disclosure of each of which is incorporated by reference in its entirety.

BACKGROUND OF THE INVENTION

1. The Field of the Invention

The present invention relates to cleaning devices, particularly to devices for cleaning of hard surfaces, such as shower walls.

2. Description of Related Art

Nearly every consumer is familiar with the necessary but undesirable task of cleaning the shower or bathtub. Various devices and methods have been employed in cleaning showers, bathtubs, and other hard surfaces, although a continuing need exists for improved devices and methods.

BRIEF SUMMARY OF THE INVENTION

One aspect of the present invention relates to a cleaning device capable of dispensing a desired amount of cleaning composition (e.g., a liquid or gel) from a container housing onto a desired surface (e.g., tile, shower wall, bathtub, and the like). The container housing includes a reservoir into which the cleaning composition is loaded (e.g., prefilled during manufacture, or filled by a consumer). In some embodiments, the container housing of the cleaning device may be squeezable, and a dispensing valve may be provided at the bottom wall of the squeezable container housing, so as to dispense cleaning composition through the dispensing valve upon squeezing the container housing. A substrate may be provided attached to the bottom wall of the squeezable container housing, to allow a user to scrub the cleaning composition onto or into a surface being cleaned (e.g., tile, shower wall, bathtub, mirror, or the like). The substrate may be one or more of a nonwoven, woven, foam, sponge, cellulose material, or other suitable material. The substrate material may be abrasive or soft depending on the cleaning application, or desired characteristics.

In an embodiment, the cleaning device includes a squeezable container housing including a bottom wall and a reservoir for holding a cleaning composition. A dispensing valve may be disposed at the bottom wall of the squeezable container housing, in fluid communication with the cleaning composition within the reservoir, so that the dispensing valve is configured to dispense the cleaning composition from the reservoir through the dispensing valve (e.g., when a user squeezes the container housing in their hand). A substrate configured as a scrubbing pad may be attached to the bottom wall of the squeezable container housing. The substrate may be disposed over or about the dispensing orifice of the dispensing valve so that upon squeezing of the squeezable container housing, the cleaning composition is dispensed from the reservoir through the dispensing orifice.

In another embodiment, the cleaning device may include a squeezable container housing including a bottom wall and a reservoir for holding a cleaning composition, a dispensing valve disposed at the bottom wall (e.g., in an opening in the bottom wall) of the squeezable container housing, a sled disposed over the bottom wall of the squeezable container housing, and a substrate configured as a scrubbing pad attached to the sled. The reservoir may be filled with cleaning composition, which can be dispensed through the dispensing valve upon squeezing of the container housing. The substrate may be disposed over or about a dispensing orifice of the dispensing valve so that when squeezed, the cleaning composition is squirted out, onto a desired surface (e.g., tile, shower wall, bathtub, mirror, or the like), or onto the substrate configured as a scrubbing pad. In any case, the substrate may then be used to scrub the cleaning composition onto or into the surface that is to be cleaned.

Another cleaning device may include a squeezable container housing including a bottom wall and a reservoir for holding a cleaning composition, a one-way dispensing valve disposed at the bottom wall of the squeezable container housing, in fluid communication with the cleaning composition within the reservoir. The dispensing valve may be configured to dispense the cleaning composition from the reservoir through the dispensing valve. A sled may be disposed over the bottom wall of the squeezable container housing, the sled providing an attachment surface to which a substrate configured as a scrubbing pad is attachable. The substrate may be disposed over or about the dispensing valve, so that upon squeezing of the squeezable container housing, the cleaning composition is dispensed from the reservoir, through the dispensing orifice. The substrate may be attached to the sled by a hook and loop attachment structure. Such a mechanical attachment structure (e.g., hook and loop) provides reliable attachment of the substrate to the remainder of the cleaning device, even where the cleaning device may be stored within a high humidity environment (e.g., a shower), which environment may cause many adhesives to fail, resulting in the two structures "peeling" apart from one another. Of course, attachment mechanisms may alternatively be used, as well.

Related methods of use may include providing a cleaning device such as described herein, dispensing a desired amount of the cleaning composition onto a surface to be cleaned (or into the substrate of the cleaning device), and using the substrate to scrub the cleaning composition onto or into the surface being cleaned. In an embodiment, the user may wait a requisite time between dispensing the composition onto the surface to be cleaned, (e.g., for disinfection or other cleaning activity provided by the cleaning composition to occur) and scrubbing the cleaning composition onto or into the surface being cleaned. In another embodiment, the user may wait a requisite time between scrubbing the cleaning composition onto or into the surface being cleaned, and rinsing the surface (e.g., with water). In another embodiment, the user may not rinse the cleaning composition from the surface being cleaned, but may allow it to remain on the surface. Where a waiting period occurs, it may be from about 5 seconds to about 5 minutes, from about 5 seconds to about 3 minutes, from about 5 seconds to about 2 minutes, or from about 5 seconds to about 1 minute.

Such methods may be used immediately before, immediately after, or during showering, using the cleaning device to dispense the cleaning composition and to clean the shower. This may be done in the flow of the shower water, if desired.

Other embodiments of cleaning devices (e.g., including a pump assembly and an associated actuator such as a push-button) are also described herein. In an embodiment, the cleaning device includes a container housing including a reservoir for holding a cleaning composition, an actuator disposed at a top end of the container housing, a pump assembly at least partially disposed within the container housing and in fluid communication with the cleaning composition within the reservoir. The actuator may be operably coupled to the pump assembly and may be configured to dispense a metered dose of the cleaning composition from the reservoir through a dispensing orifice, into the substrate. The substrate may be attached to a scrubbing surface (also referred to herein as a scrubbing side) of the container housing, the substrate being disposed over or about the dispensing orifice so that upon actuation of the actuator (e.g., a button), the cleaning composition is dispensed from the reservoir, through the dispensing orifice, and into the substrate.

In an embodiment, the cleaning device includes a container housing including a reservoir for holding a cleaning composition, an actuator that may be disposed at a top end of the container housing, configured to be actuated by a finger (e.g., index finger) of a user as the user grips the container housing. A pump assembly may be at least partially disposed within the container housing and be in fluid communication with the cleaning composition within the reservoir. The actuator may be operably coupled to the pump assembly and configured to dispense a metered dose of the cleaning composition from the reservoir through a dispensing orifice into a substrate upon actuation of the actuator by the user. The substrate may be provided attached to a generally vertical scrubbing side of the container housing when the container housing is oriented upright, against a shower wall or other vertical hard surface to be cleaned. The substrate may be disposed over or about the dispensing orifice, and the dispensing orifice may be oriented generally horizontally relative to the generally vertical scrubbing surface when the container housing is oriented upright, against the shower wall or other vertical hard surface to be cleaned. Upon actuation of the actuator, the cleaning composition may be dispensed from the reservoir, through the dispensing orifice, and into the substrate.

The device advantageously may provide for a metered dose of the cleaning composition, sprayed onto or into the substrate (e.g., a nonwoven), with the dispensing orifice and associated delivery channel in a generally horizontal orientation. Often, existing dispensing systems have difficulty dispensing a composition when the delivery channel and dispensing orifice is generally horizontal, as provided herein. The device may be employed for dispensing the cleaning composition in a variety of orientations and/or angles, e.g., as would exist when pressing the substrate on the scrubbing surface against a shower wall, a bathtub, a shower shelf, shower or bathtub floor, ceiling, etc. Thus, no matter the orientation of the device, the delivery channel and the dispensing orifice, actuation of the actuator may be effective to cause dispensing of the desired metered, unit dose of the cleaning composition to the substrate, where it can then be scrubbed against the surface to be cleaned. The system may advantageously be sealed, so as to prevent contamination of the cleaning composition as might otherwise occur through backflow of cleaning composition and/or water (e.g., shower water) back into the reservoir. This may be of particular benefit where the device is used while the user is showering, in the flow of the shower water. For example, the pump assembly may include a one-way valve to prevent such backflow.

The device may further be configured for use and prolonged storage within a relatively high humidity environment (e.g., in the shower), without degradation of any adhesive between the substrate and the scrubbing side of the container housing. For example, many adhesives are not compatible with prolonged storage and use in such high humidity environments, which would lead to unwanted separation between the substrate and the surface of the container housing to which the substrate is attached.

Another embodiment of the present invention is directed to a method of cleaning a shower. Such a method may include providing a cleaning device such as that described herein, and using the cleaning device to dispense the cleaning composition and clean the shower. Such cleaning (e.g., scrubbing of shower walls, shelves, floors, ceiling, etc.) may be performed immediately before, immediately after, or while the user showers (e.g., cleaning the shower in the flow of the shower water). The cleaning composition may be skin safe so as to not irritate the skin of the user to better facilitate such use.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
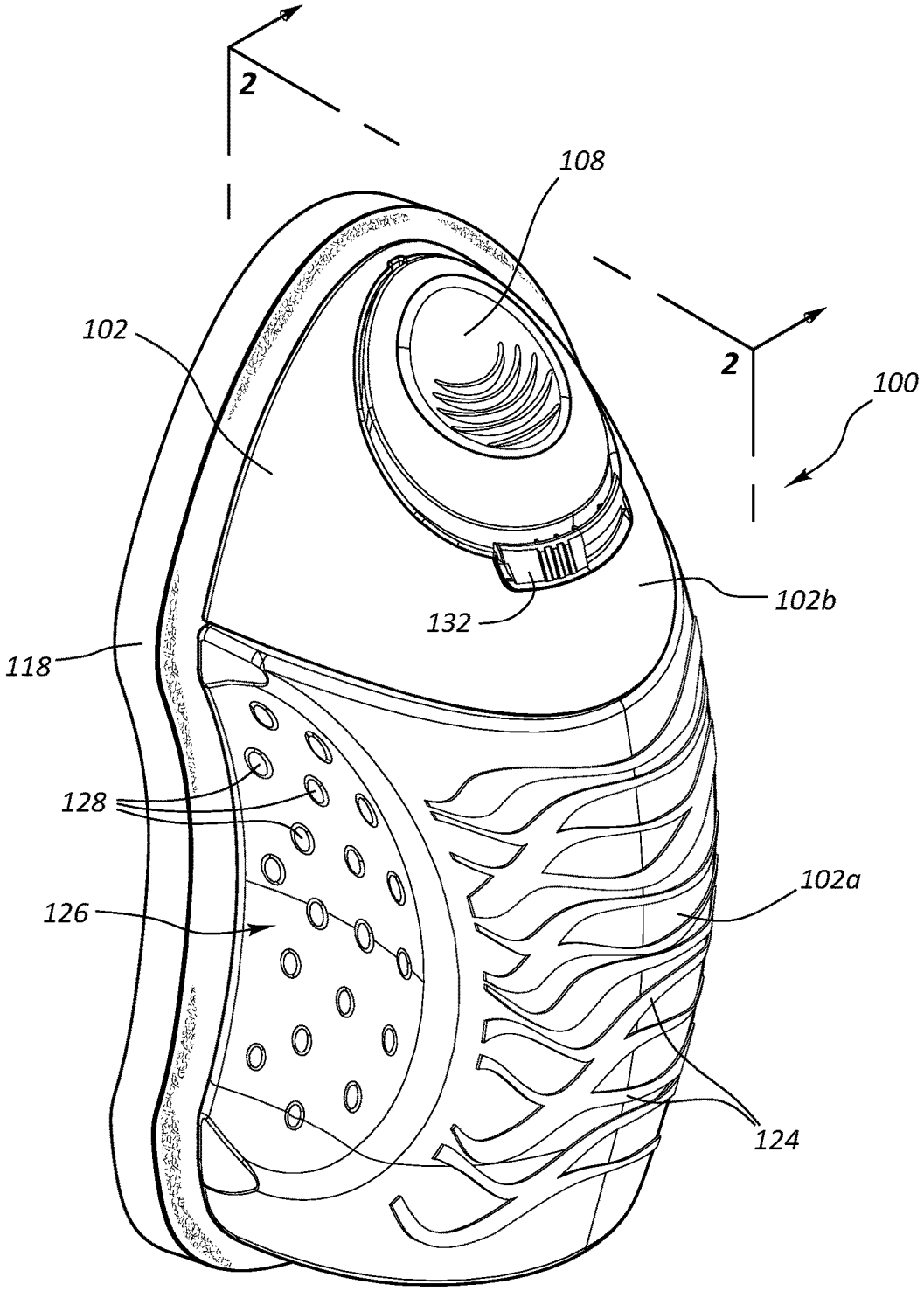
FIG. 1 is a perspective view of an exemplary cleaning device.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Unless otherwise stated, all percentages, ratios, parts, and amounts used and described herein are by weight.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 25%, within 20%, within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 25%, within 20%, within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition.

As used herein, the term "substrate" is intended to include any material that is used to clean an article or a surface. Examples of cleaning substrates include, but are not limited to nonwovens, sponges, wovens, and similar materials which can be attached to the cleaning device.

As used herein, the terms "nonwoven" or "nonwoven web" means a web having a structure of individual fibers or threads which are interlaid, but not in an identifiable manner as in a knitted web. Nonwoven webs may be formed from many processes, such as, for example, meltblowing, spunbonding, needle punching and bonded carded web processes.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

In an aspect, the present invention is directed to an all-in-one cleaning device, e.g., such as may be used in cleaning the inside of a shower. The device may provide the ability to dispense a cleaning composition carried within the device itself, and scrub the composition into or against the surfaces to be cleaned (e.g., shower walls, bathtub, shower shelves, floors, corners, ceilings, etc.). In an embodiment, the container housing may be squeezable, and the cleaning device may include a dispensing valve configured to dispense the cleaning composition through a dispensing orifice of the dispensing valve when a user squeezes the container housing (e.g., when the squeezing force exceeds a threshold amount).

A substrate (e.g., configured as a scrubbing pad) may be attached to the bottom wall of the squeezable container housing, with the substrate disposed over or about the dispensing orifice of the valve so that upon squeezing of the container housing, the cleaning composition is dispensed from the reservoir, through the dispensing orifice of the valve. A sled may be provided over the bottom wall of the container housing, between the bottom wall and the substrate. The sled may serve to cap an opening in the bottom wall of the squeezable container housing (e.g., in which opening the dispensing valve may be disposed), and to provide an attachment surface to which the substrate is attached (e.g., by a hook and loop structure, although other attachment mechanisms are also possible). Such embodiments allow a user to squeeze the container housing, squirting out a desired volume of the cleaning composition so that it may land on the surface to be cleaned. Where the substrate covers the dispensing orifice, of course the cleaning composition may be squirted into the substrate. In either case, the substrate may be used to scrub the cleaning composition on or into the surface to be cleaned.

Other embodiments of the cleaning devices described herein may not include a squeezable container housing, but the container housing may be more rigid, and dispensing may be achieved by providing an actuator and pump assembly or other dispensing mechanism on or within the container housing. For example, activation of a dispensing mechanism (e.g., an actuator and a pump assembly) of the cleaning device may dispense a metered dose (e.g., about 0.6 cc) of composition, in a generally horizontal direction, into a nonwoven substrate. The dispensing mechanism may not rely on gravity (i.e., not gravity fed) for dispensing, and may be sealed to prevent leaking and/or unwanted backflow of shower water or other material, preventing contamination.

The cleaning device may include a container housing including a reservoir for holding a cleaning composition, an actuator, e.g., disposed at a top end of the container housing, a pump assembly at least partially disposed within the container housing and in fluid communication with the cleaning composition within the reservoir. The actuator may be operably coupled to the pump assembly and configured to dispense a metered dose of the cleaning composition from the reservoir through a dispensing orifice, onto or into a substrate. The substrate may be attached to a scrubbing surface of the container housing. The substrate may be disposed over or about the dispensing orifice so that upon actuation of the actuator, the cleaning composition is dispensed from the reservoir, through the dispensing orifice, to the substrate.

According to another aspect, the present invention provides a method of using any of the cleaning devices disclosed herein. For example, the cleaning device may be used to clean the shower immediately before, immediately after, or while the user is showering (e.g., cleaning in the flow of the shower water). Such a method may include providing a cleaning device as described herein, and immediately before, immediately after, or during showering, using the cleaning device to dispense the cleaning composition and to clean the shower. As mentioned, this may be done in the flow of the shower water. The cleaning composition may be formulated so as to be skin safe so as to not irritate the skin of the user as the user cleans the shower in the flow of the shower water.

This cleaning device can be used on kitchen surfaces, which may include, but may not limited to, multi-purpose, countertop, sinks, drains, faucets, fixtures, tables, stove top, range hood, ovens (inside and outside), microwave, small appliances, refrigerator, cutting boards, cabinets, trash cans, walls and surrounding areas. This cleaning device can also be used in the bathroom, which may include, but may not limited to, countertop, sinks, drains, faucets, fixtures, mirrors, cabinets, trash cans, toilet, toilet seat, shower, floor, shower door, curtains, walls and surrounding areas. This cleaning device may be used around the home, which may include, but not limited to, floor, carpet, BBQ grill, oven rack, outdoor furniture, and soft surfaces such as on fabrics.

III. Exemplary Cleaning Devices

Embodiments of cleaning devices including an actuator and pump assembly will be described first, followed by a description of cleaning devices including a squeezable container housing and a dispensing valve configured to dispense the cleaning composition through the dispensing valve upon squeezing of the container body. It will be appreciated that features described in the context of one type of embodiment may be incorporated within the other type of embodiment, and vice versa.

Figure 2:
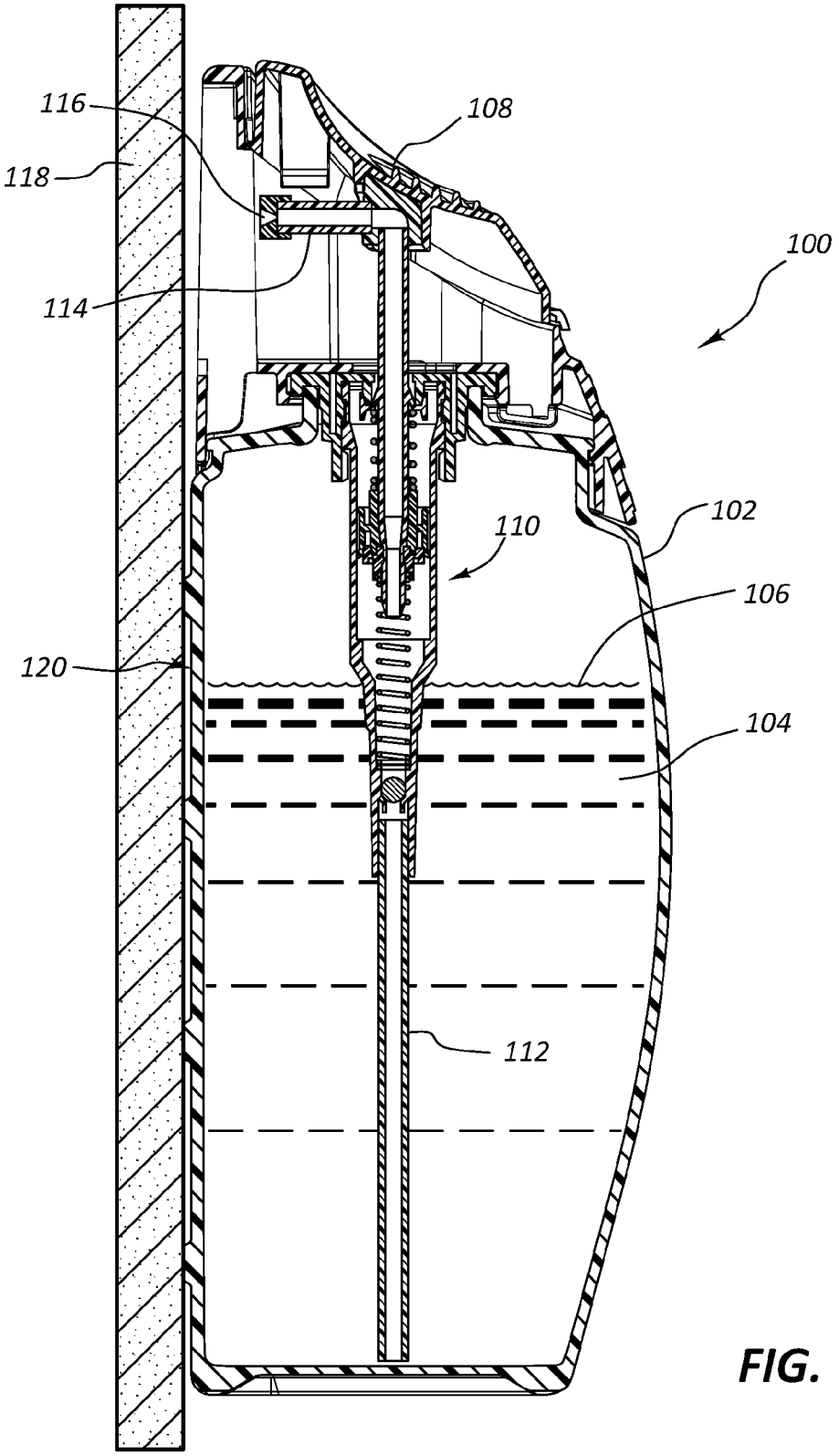
FIG. 2 is a cross-sectional view through the cleaning device of FIG. 1.
Figure 3:
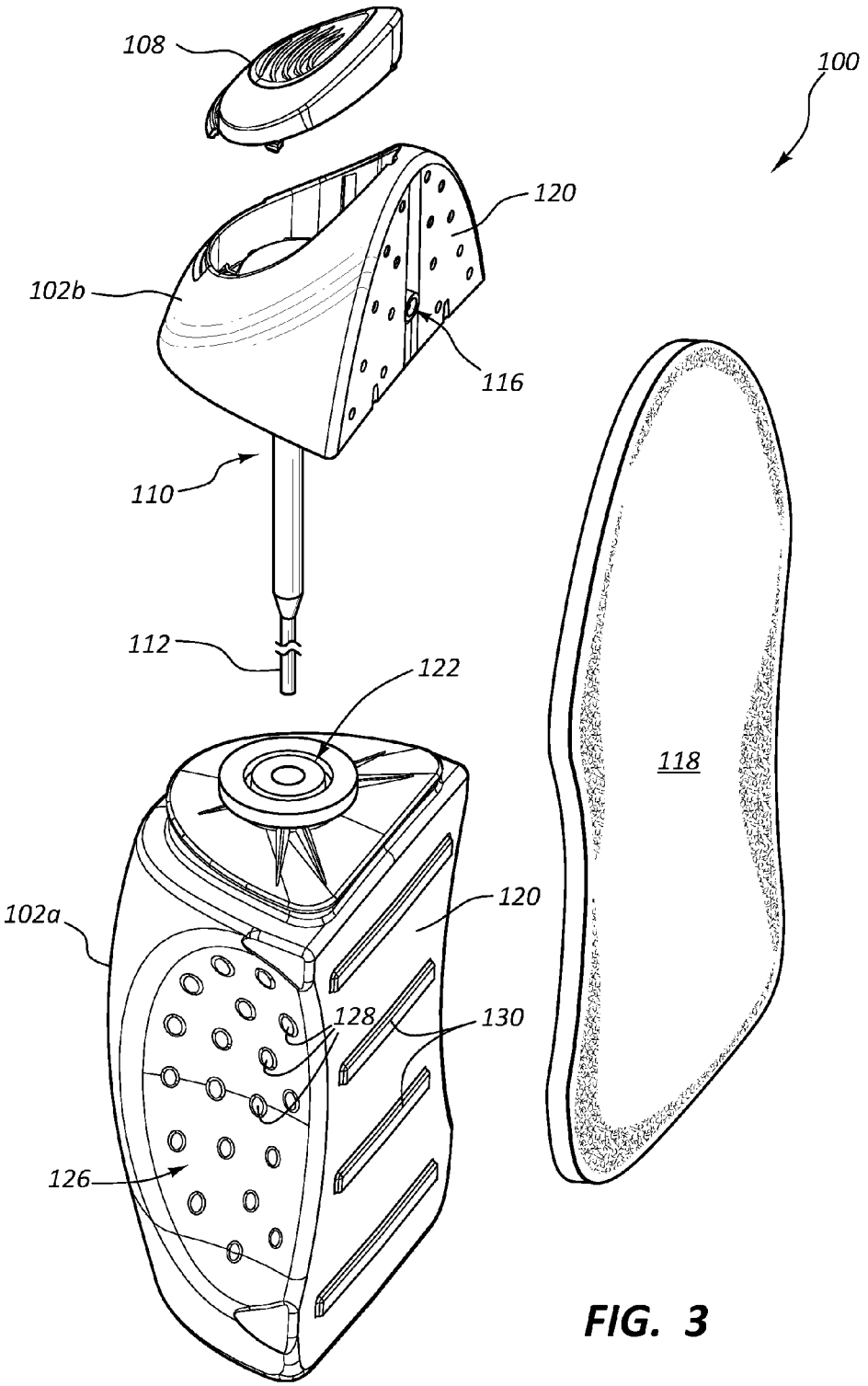
FIG. 3 is an exploded view of the cleaning device of FIG. 1.
Figure 4A:
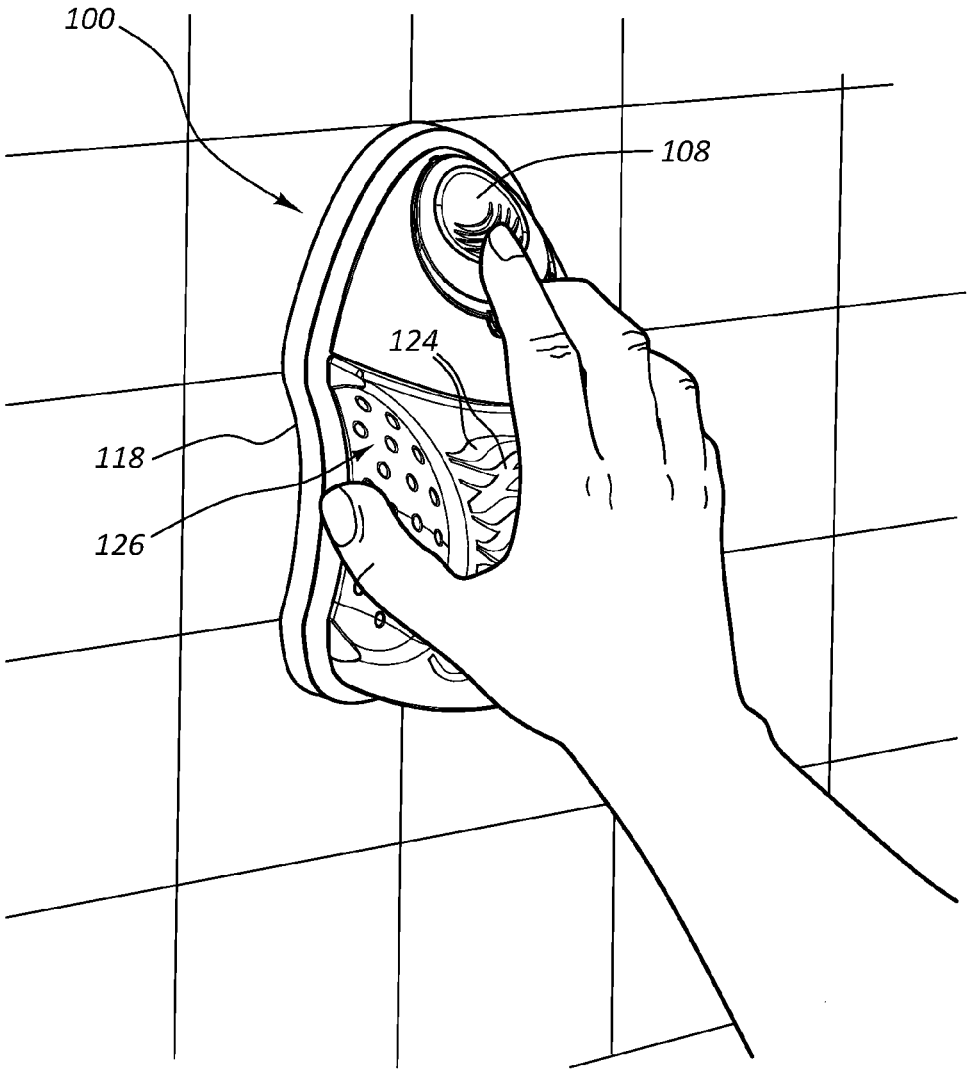
FIGS. 4A-4B show a user using the device to scrub a shower wall.

FIGS. 1-3 show an exemplary cleaning device 100 including a container housing 102 which includes a reservoir 104 for holding a cleaning composition 106. Composition 106 may be preloaded within the reservoir 104 of container housing 102, e.g., during manufacture. Cleaning device 100 may further include an actuator 108 (e.g., a button). Actuator 108 is shown as disposed at a top end of device 100, while container housing 102 is particularly shaped to provide for easy single-handed gripping of housing 102, e.g., between a thumb and fingers of a user's hand (see FIG. 4A). Positioning of actuator 108 at a top end of device 100 facilitates pressing or other actuation of actuator 108 by the user's index finger, as shown in FIG. 4A, to dispense the cleaning composition 106.

As perhaps best seen in the cross-sectional view of FIG. 2, a pump assembly 110 may be provided at least partially disposed within container housing 102, in fluid communication with cleaning composition 106. Button or other actuator 108 may be operably coupled to pump assembly 110, so as to be configured to dispense a metered dose (e.g., a calibrated amount) of the cleaning composition 106 upon pressing or otherwise actuating actuator 108. Upon pressing actuator 108, e.g., a suction force may be generated, forcing the metered amount of composition 106 up from reservoir 104, through dip tube 112, up through delivery channel 114, to dispensing orifice 116. At dispensing orifice 116, composition 106 may be sprayed or otherwise dispensed into substrate 118. As seen in FIG. 1, a lock 132 or tab other suitable mechanism may be provided to prevent inadvertent actuation of (e.g. during shipment, storage, etc.) of actuator 108.

Substrate 118 may be attached to scrubbing surface 120 of container housing 102. As seen in FIG. 2, substrate 118 may be disposed over, or about the dispensing orifice 116, so that upon actuation of actuator 108, cleaning composition 106 is dispensed from reservoir 104 through orifice 116, and into substrate 118. In an embodiment, the substrate 118 may include one or more holes through which the composition 106 is dispensed. In another embodiment, it may cover the orifice 116, so as to be dispensed directly into the substrate. Substrate 118 may comprise any suitable material that can be used to scrub and clean the surface (e.g., a shower wall, bathtub, etc.) against which it is pressed and scrubbed (e.g., moved in generally circular motions, moved up and down, or side to side, while pressing the device and substrate 118 against the surface being cleaned).

In an embodiment, substrate 118 may be nonwoven. In another embodiment it may be a foam pad, an abrasive pad, bristles, sponge, a woven material, or otherwise configured. Use of a nonwoven may aid in developing as the substrate with cleaning composition therein is scrubbed into the desired surface. In an embodiment, the substrate may be a relatively high loft material that is easily compressed when pressure is applied during the cleaning process. The high loft material may be designed to help mechanically generate foam in the cleaning composition as it is dispensed through the substrate. The substrate 118 may be absorbent, or non-absorbent (e.g., a synthetic non-absorbent). Substrate 118 may be sufficiently durable so as to be used for several uses. For example, the cleaning device 100 may be configured as an all-in one cleaning tool, prefilled with a desired amount of cleaning composition, e.g., sufficient for at least about 10, at least about 20, not more than about 50, or not more than about 40 shower cleanings (e.g., about 30 cleanings).

As shown in FIG. 1, substrate 118 may be oversized relative to the scrubbing surface 120 of container housing 102. In other words, substrate 118 may extend beyond the outer perimeter of housing 102. Such a configuration increases the surface area associated with substrate 118 for scrubbing, and also facilitates easier reach of substrate 118 into corners, particularly with the rounded or pointed top of the substrate 118 and housing 102 seen in FIG. 1.

In an embodiment, the substrate and/or cleaning composition 106 may include an antimicrobial agent therein. For example, the substrate 118 may include silver ions provided therein. An exemplary substrate may be a polyethylene terephthalate (PET) fiber blend (e.g., including various denier fibers). Suitable substrates are available from Filtrair (Heerenveen, Netherlands). In one embodiment the substrate may include a binder to adhere one or more substrate materials and/or layers together. The binder may have antimicrobial properties that aid in keeping the substrate free from bacteria or microbes between uses. Suitable examples of other antimicrobials which may be used on the nonwoven substrate, with or without a binder, include but are not limited to: SPOR-AX Antimicrobial agent provided by Fiberbond Corporation (Michigan City, Ind.) and AEGIS antimicrobial from the AEGIS Microbe Shield Technology provided by Microban International (Huntersville, N.C.) and quaternary ammonium compounds such as, 3-trimethoxy silyl propyl dimethyl octadecyl ammonium chloride. In another embodiment of the invention, the substrate materials utilize capillary and/or wicking properties to efficiently distribute the cleaning composition throughout the substrate after it is sprayed.

As shown in FIG. 2, the scrubbing surface 120 of housing 102 may include ribs or protrusions 130, or other texturing (e.g., roughened texture) on an underside thereof in order to improve bonding of substrate 118 to the scrubbing surface 120. Other than such ribs or protrusions 130, scrubbing surface 120 may be generally planar (e.g., flat). Substrate 118 may be secured to surface 120 by mechanical mechanisms (e.g., interlock between surface 120 and substrate 118), use of an adhesive, or combinations thereof. Although in an embodiment, the substrate 118 may be permanently, non-removably attached to surface 120, in another embodiment, it may be detachable (e.g., to permit replacement). Suitable attachment structures include but are not limited to: an adhesive between the substrate and the housing, a slide-on or snap-fit bracket attaching to the housing wherein the bracket attaches to substrate, a hook and loop attachment structure between the substrate and the housing, and any other suitable attachment structures. In one embodiment, the housing comprises high density polyethylene (HDPE) and soft touch which aids in allowing an adhesive to bond between the housing and the substrate material. The addition of the soft touch to the HDPE material allows the adhesive to retain the substrate in a fixed arrangement through many uses and with vigorous scrubbing.

In an embodiment, the substrate may include two or more differently configured portions. For example, bristles, or other substrate disposed at a top portion of the cleaning device may be stiffer and/or more abrasive as compared to other portions of the substrate, for use in better cleaning corners, grout lines between tiles, etc.

Figure 5A:
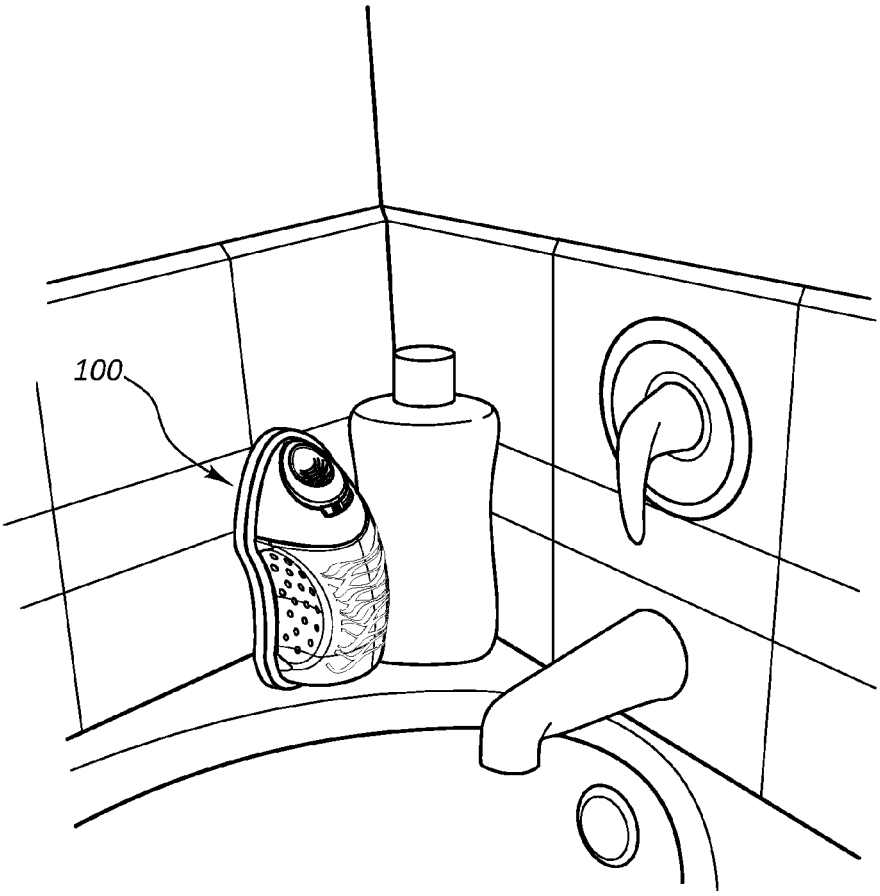
FIGS. 5A-5B shows how the device may be stored between uses in the shower and/or bathtub.
Figure 5B:
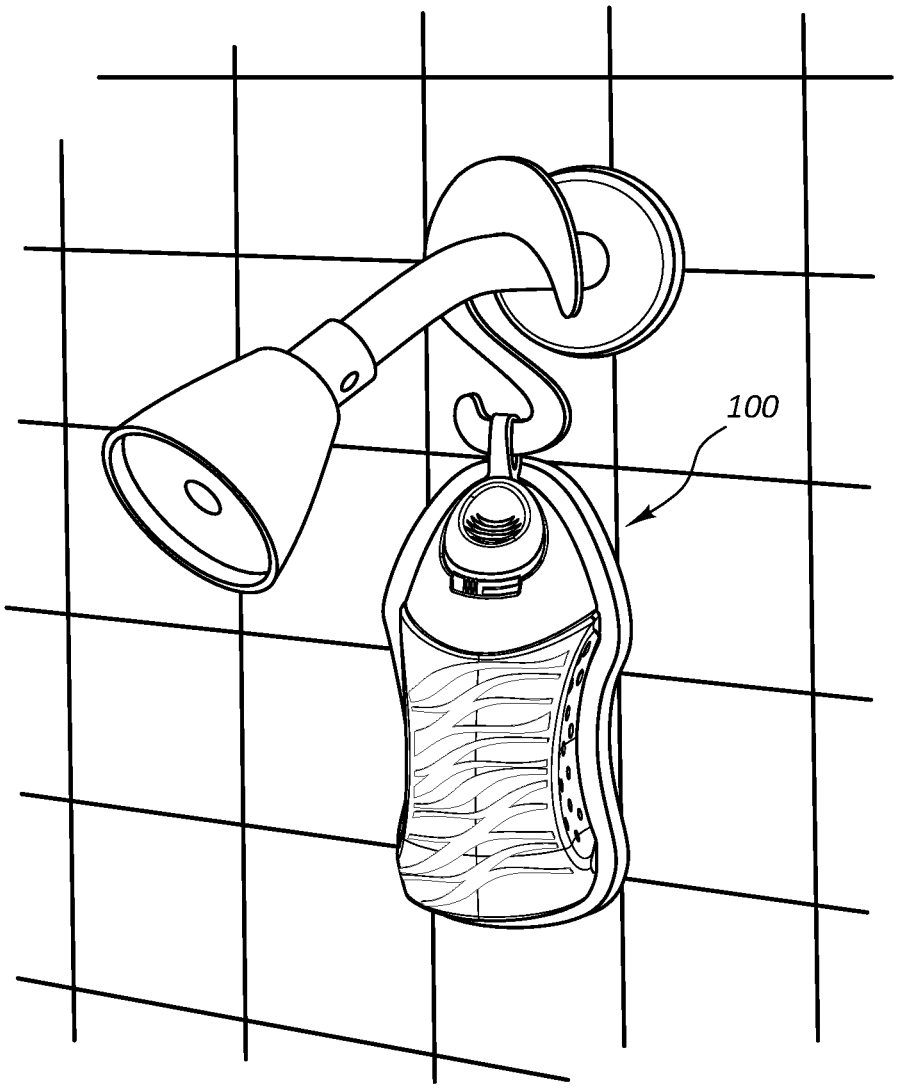
Figure 6:
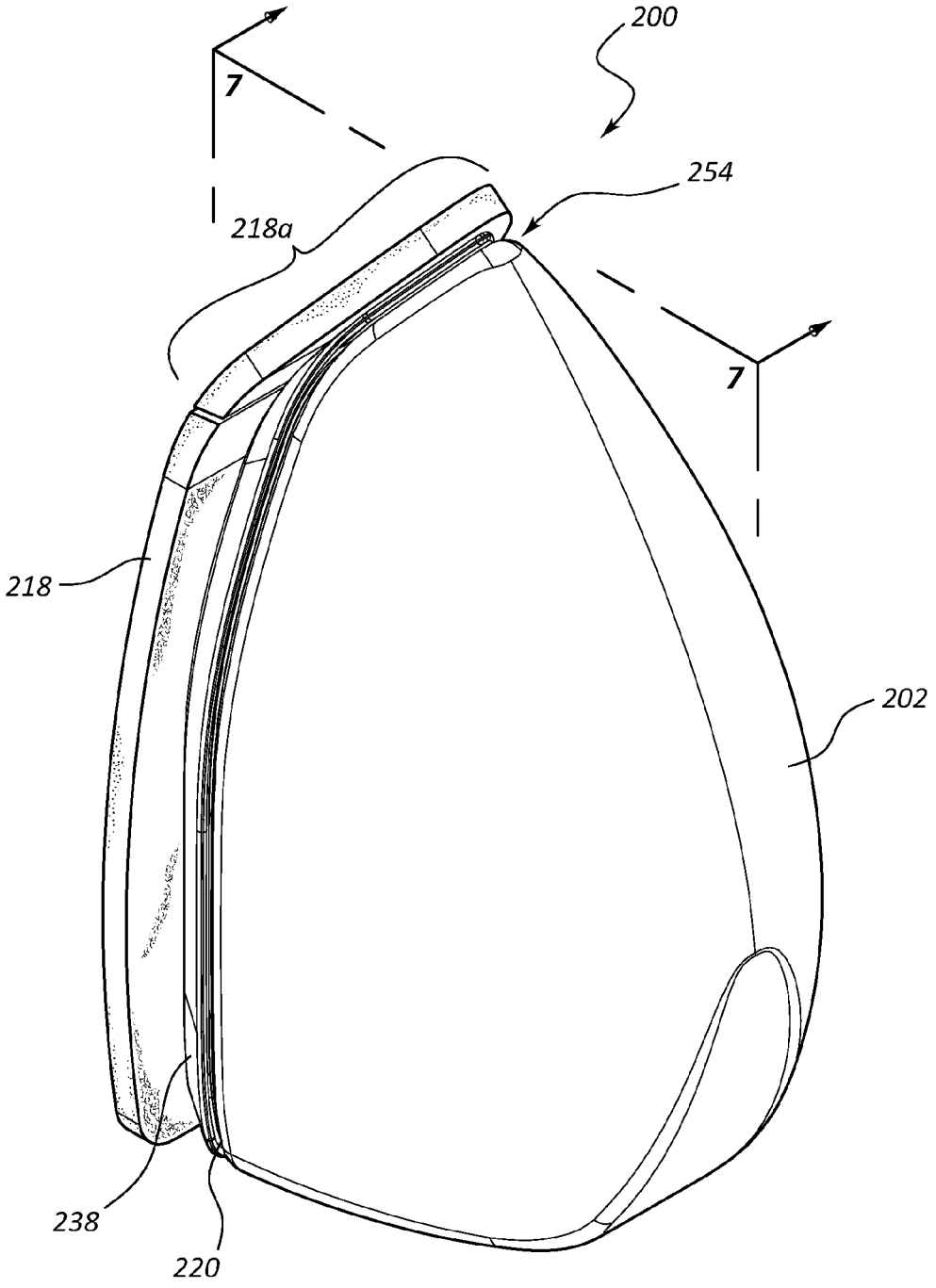
FIG. 6 is a perspective view of another exemplary cleaning device, that may include a squeezable container housing.

The cleaning device may be stored in the shower, as described herein and shown in FIGS. 5A-5B. In such conditions, the device, including substrate 118 and any adhesive attaching substrate 118 to surface 120 is regularly subjected to a high humidity environment. In addition, the substrate and the remainder of device 100 may often be contacted with water (e.g., flowing shower water, etc.). Many adhesives will not tolerate such conditions, but tend to peel and separate between the surfaces meant to be joined together when subjected to such conditions for an extended period. The present inventors have found that when using polyolefin-based glues with a synthetic polymer backbone of polyethylene as an adhesive, the adhesive is able to mimic the plastic it is bonding to and it minimizes any separation problems between the plastic and adhesive under high humidity use and storage. Suitable adhesives include, but are not limited to, hot melt adhesives, polyolefin-based glues with a synthetic polymer backbone of polyethylene, rubber-based glues with a styrene-butadiene polymer backbone, and any combinations or mixtures thereof. Suitable adhesive materials, such as TECHNOMELT DM 800B DIPSOMELT and TECHNOMELT DM 106C DIPSOMELT, materials are available from the Henkel Corporation (Düsseldorf, Germany).

Pump assembly 110 may be configured to work in a manner that does not rely on gravity feed of the cleaning composition towards the dispensing orifice 116, as do various existing cleaning devices. Rather, the pump assembly may rely on generation of a suction force upon pressing or other activation of actuator 108, to draw composition 106 into dip tube 112. In one embodiment, the dip tube may be provided at an angle or curved so that in a horizontal orientation, as shown in FIG. 2, the bottom opening dip tube 112 would be closer to surface 120 than the center of the container housing 102. The particular pump mechanism employed in assembly 110 may advantageously be particularly configured so as to reliably operate no matter the orientation of the device, or the orientation of the pump assembly. For example, many existing pump assembly configurations perform poorly, if at all, in so far as effective and accurate dispensing of the desired dose of composition, when the dispensing orifice or delivery channel adjacent thereto is oriented generally horizontally.

As seen in FIG. 2, the delivery channel 114 and orifice 116 are generally horizontal, in order to deliver the cleaning composition 106 into generally vertical substrate 118 (e.g., as it is pressed against a vertical shower wall). FIG. 4A illustrates such use, where the device may typically be oriented vertically, parallel to a shower wall or similar structure being scrubbed. In such an orientation, and even when device 100 is rotated clockwise or counterclockwise 90° (e.g., oriented sideways, 45° degree angle, etc.) in either direction or at any angle in between 0°-90° and 270°-360° the device will continue to reliably dispense the cleaning composition. Such changes in orientation (any any orientations therebetween) may be common as a user scrubs up and down, and side to side over a shower wall, bathtub, or similar surface.

Pump assemblies having such desirable operation characteristics are available from various manufacturers. For example, Guala Dispensing (Mt. Pleasant, S.C.) manufactures pump assemblies that may be suitable for use, in conjunction with the actuator 108, delivery channel 114, and orifice 116. Various other pump assemblies providing similar operational characteristics may also be suitable for use.

FIG. 3 shows an exploded view of cleaning device 100, showing a configuration in which the container housing 102 may be provided in two parts, e.g., a lower housing portion 102*a* that includes reservoir 104, and an upper shroud portion 102*b* that may couple to pump assembly 110, and into which actuator 108 may be coupled. As shown, lower housing portion 102*a* may include a hole 122 into which dip tube 112 of pump assembly 110 may be received. Any of various suitable mechanisms may be employed to attach portions 102*b* and 102*a* together, e.g., a bayonet coupling, a snap fit, a screw-on connection, welded connection, use of an adhesive, combinations thereof, etc. A seal may be provided at any such attachment location between housing portion 102*a* and shroud 102*b*, particularly a seal between pump assembly 110 and housing portion 102*a*. Examples of such seals may include, but are not limited to a plug seal, a rib seal, a crab claw seal, a friction seal, combinations thereof, etc. One of skill in the art, in light of the present disclosure, will appreciate various specific configurations that may be employed.

In an embodiment a tight (e.g., air-tight, and/or water-tight) seal may be provided relative to pump assembly 110 and reservoir 104, so as to prevent contamination, backflow, or other issues resulting from undesirable contact or flow between such structures. For example, where the cleaning device 100 is used to clean a shower wall, bathtub or similar surface in the flow of shower water, in bathwater, or even submerged in a bathtub, advantageously the device may prevent such water present from backflowing into the reservoir (e.g., through orifice 116, channel 114, and diptube 112). Prevention of such backflow may be advantageous, particularly where the device 100 is used in such environments where shower water, bath water, etc. may contact the exterior surfaces of the cleaning device. In addition to a seal between assembly 110 and reservoir 104, any valve included in the pump assembly 110 for dispensing the composition may be a one-way valve, so as to prevent backflow.

In an embodiment, the lower housing portion 102*a* including reservoir 104 may be blow molded, injection molded, or otherwise formed from a suitable plastic material. The shroud portion 102*b* may be formed from similar or other suitable manufacturing techniques from a suitable plastic material (e.g., polypropylene, polyethylene, other polyolefins, etc.).

In an embodiment, the lower housing portion 102*a* (e.g., that portion typically gripped by the user) may include an elastomeric grippable portion 124 or material (e.g., overmolded) or otherwise provided over housing portion 102*a*. In an embodiment, such a portion 124 may be provided by an Adflex TPO (thermoplastic polyolefin) which creates soft touch coating. Suitable soft touch coatings may comprise an ethylene-propylene copolymer, 1-propene-ethylene copolymer, or combinations thereof. Various other suitable providers of such grippable, soft touch coatings or materials will be apparent to one of skill in the art. Adflex TPO materials, such as Adflex Q 302 B, soft touch coating materials are available from Lyondellbassell (Houston, Tex.). In one embodiment of the invention, the soft touch material is blended with the HDPE so that the soft touch material is about 5-30% by weight, or about 5-20% by weight or about 5-15% by weight of the soft touch/HDPE blend.

Such grippable portion 124 may include a decorative or other pattern (e.g., raised, embossed, etc.) provided therein. Such grippable portion may aid the user in retaining a good grip on the cleaning device 100, particularly in the contemplated environment, where it may be quite wet. As shown, the sides of housing portion 102*a* may include concavely curved portions 126 on opposite sides, to better facilitate gripping, e.g., between a thumb and finger(s) of a single hand. Such concave portions 126 may further include bumps or protrusions 128 to further improve grip of the device within the hand of a user. The top region of housing portion 102*a* may be convexly curved, to ergonomically fit within the palm portion of the user's hand. The result of such features for improved grip are readily seen in FIG. 4A.

As seen in FIGS. 4A-4B and FIG. 5A-5B, the device 100 may typically be vertically oriented, at least for a portion of the time during cleaning, and also during storage. Such a generally vertical orientation during storage allows the substrate to dry under influence of gravity, as water drains from the substrate downwards, towards the bottom of the device. Such a vertical standing orientation allows the substrate to dry in between uses. In this embodiment, the bottom of the device is flat so that it may easily stand and not tip over in a vertical storage orientation which allows the substrate to dry between uses. Such drying is further aided by the sealed characteristics of the lower container housing portion 102*a*, and the metered dose characteristics, which aid in preventing leakage of composition 106 during storage.

The cleaning composition may typically be an aqueous composition including a surfactant, and water. Various other components may also be present. An organic or mineral acid (e.g., to aid in cleaning) may be included. One or more of a chelating agent, an oxidizing agent (e.g., any peroxide, such as hydrogen peroxide, or a hypochlorite, (e.g., sodium hypochlorite), or hypochlorous acid, or combinations thereof), or one or more other adjuncts selected from the group consisting of fragrances, dyes, preservatives, humectants, solvents, polymers, pH adjusters, solubilizers, and combinations thereof may also be provided.

The composition may have a viscosity so that it may readily be dispensed as described herein. Liquid compositions may have a viscosity of less than 10,000 cps, or less than 1,000 cps. Gel compositions may also be suitable for dispensing as described herein, and may have relatively higher viscosities.

In one embodiment, the composition may have a pH from about 4 to about 8 (about 4, about 5, about 6, about 7, or about 8, or any range defined between any such values). The composition may limit the surfactant concentration to below about 5% by weight. The pH, surfactant concentration, surfactant type, and concentration and/or presence of other components may be specifically configured to ensure that the composition is skin safe so as to not irritate the skin of a user as the user cleans the shower, e.g., even in the flow of the shower water.

Under such conditions, it will be apparent that contact of the cleaning composition with the user's skin is likely to occur. In an embodiment, the composition may be formulated to not irritate the eyes, should the composition get splashed into, or otherwise contact the eye(s) of the user. Such skin safety or eye safety characteristics may be determined by any suitable test, such as by a standard repeat insult patch test (RIPT) test. In an embodiment, the cleaning composition will pass an in vitro dermal irritancy test. In an embodiment, the cleaning composition will pass an in vitro eye irritancy test. In an embodiment, the cleaning composition will pass both an in vitro dermal irritancy test and an in vitro eye irritancy test. Suitable OECD in vitro test methods include but are not limited to: 431 skin corrosion; 430 skin corrosion; 437 BCOP Bovine Corneal Opacity and Permeability; 439 skin irritation, and other tests for skin or eye irritation.

In an alternative embodiment, the composition contains a hypochlorite component and the pH range is between 8 and 14, preferably between 9 and 13, more preferably between 10 and 13. In the embodiment of the invention that contains hypochlorite, the composition in the cleaning device is designed so that the user may dose the substrate directly which minimizes skin contact and any overspray that a user would normally experience with a traditional cleaning tool or sprayer.

In one embodiment, the cleaning composition may include one or more surfactants. Examples include, but are not limited to sulfates, sulfonates, betaines, alkyl polysaccharides, (e.g., alkyl polyglycosides, also known as alkyl polyglucosides), amine oxides, tweens, alcohol ethoxylates, and combinations thereof. One or more of the selected surfactants may provide foam building characteristics. The surfactant concentration may be less than 5% by weight, less than 4%, less than 3%, or less than 2% by weight (e.g., 1% to 2% by weight).

The surfactant(s) may include nonionic, anionic, cationic, ampholytic, amphoteric, zwitterionic surfactants, and mixtures thereof. A typical listing of anionic, ampholytic, and zwitterionic classes, and species of these surfactants, is given in U.S. Pat. No. 3,929,678 to Laughlin. A list of cationic surfactants is given in U.S. Pat. No. 4,259,217 to Murphy. Various alkyl polysaccharide surfactants are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al. U.S. Pat. No. 4,565,647 to Llenado. Various nonionic surfactants can be found in U.S. Pat. No. 3,929,678 to Laughlin. Each of the above patents is incorporated by reference.

An organic acid (e.g., citric acid), or relatively weaker mineral acid (e.g., phosphoric acid) may be included for cleaning. Where included, such an acid may be included in an amount of less than 5%, less than 4%, less than 3%, less than 2% (e.g., from 1% to 2%, or from greater than 0.5% to about 1.5%).

Exemplary organic acid may include 2-hydroxycarboxylic acids or mixtures of two or more acids. Examples of such acids include, but are not limited to, tartaric acid, citric acid, malic acid, mandelic acid, oxalic acid, glycolic acid, lactic acid, and acetic acid. Citric acid, lactic acid, or mixtures thereof may exhibit an antimicrobial effect.

pH adjusters (e.g., sodium hydroxide, or another hydroxide), if present, may typically be included in an amount of less than 3%, less than 2%, less than 1% (e.g., from about 0.5% or greater than 0.5% to 1%). For adjusting pH downward, any of the above described acids may also be suitable for use.

Solubilizers (e.g., to solubilize a fragrance or other oil), if present, may typically be included in an amount of less than 1%, less than 0.5%, less than 0.3% (e.g., from about 0.01% to 0.5%).

Dyes, fragrances, and/or preservatives, if present, may typically be included in an amount of less than 1%, or less than 0.5%. Any other components (e.g., oxidizers, or others mentioned herein) may be present in amounts of less than 10%, less than 5%, less than 4%, less than 3%, less than 2%, less than 1%, or less than 0.5%

Exemplary cleaning composition formulations are shown in Tables 1-3 below, with the balance being water.

TABLE 1

| Component | Function | Weight Percent Active |
|---|---|---|
| Cocamidopropyl betaine | Surfactant/Cleaning/Foam | 0.45-0.75 |
| C8-C16 Alkyl polyglucoside | Surfactant/Cleaning/Foam | 0-0.75 |
| Citric Acid | Cleaning | 0.53-1.50 |
| Sodium Hydroxide | pH Adjuster | 0.59-0.86 |
| Sorbitan Oleate | Fragrance Solubilizer | 0-0.2 |
| Decylglucoside Crosspolymer | | |
| Methyl chloro isothiazolinone; Methyl isothiazolinone | Preservative | 0.08 |
| Dye | Dye | 0.002 |
| Fragrance | Fragrance | 0.15-0.3 |

TABLE 2

| Component | Function | Weight Percent Active |
|---|---|---|
| Sodium Laureth Sulfate | Surfactant/Cleaning/Foam | 0.25-0.75 |
| C8-C16 Alkyl polyglucoside | Surfactant/Cleaning/Foam | 0.50-2.5 |
| Citric Acid | Cleaning | 0.50-2.50 |
| Sodium Hydroxide | pH Adjuster | 0.40-0.86 |
| Glycerin | Solubilizer | 0-2.0 |

TABLE 2-continued

| Component | Function | Weight Percent Active |
|---|---|---|
| Methyl chloro isothiazolinone; Methyl isothiazolinone | Preservative | 0.05-0.20 |
| Dye | Dye | 0-0.01 |
| Fragrance | Fragrance | 0.05-0.4 |

TABLE 3

| Component | Function | Weight Percent Active |
|---|---|---|
| Sodium Hypochlorite | Oxidant | 1.0-2.80 |
| Lauryl Dimethylamine Oxide | Surfactant/Cleaning/Foam | 0.2-0.75 |
| Sodium Silicate N | pH Adjuster | 0.0-0.20 |
| Sodium Hydroxide | pH Adjuster | 0.05-0.75 |
| Alkyl Dimethyl Benzyl Ammonium Chloride | Surfactant/Cleaning | 0.10-0.80 |
| Potassium Iodide | Stabilizer | 0.0-0.10 |
| Fragrance | Fragrance | 0.01-0.15 |

The cleaning composition may be effective at cleaning, and removing soils typically present in showers and bathtubs, such as, but not limited to soap scum, hard water stains, mildew, etc. The composition could also be used in other cleaning environments, e.g., such as kitchens, bathroom sinks, walls, etc. In a kitchen environment, the composition may be effective at cleaning and removing kitchen grease. Although described principally in the context of a shower cleaning tool, the cleaning device may be employed for personal care (e.g., delivery of a body wash), auto or other vehicle care (e.g., washing a car, tires, etc.), or in health care (e.g., delivery of an antiseptic wash or other composition to the body). Other surfaces to be cleaned may include bathroom countertops, kitchen countertops, sinks, tables, stovetops, dishes, windows, mirrors, floors, etc.

Figure 4B:
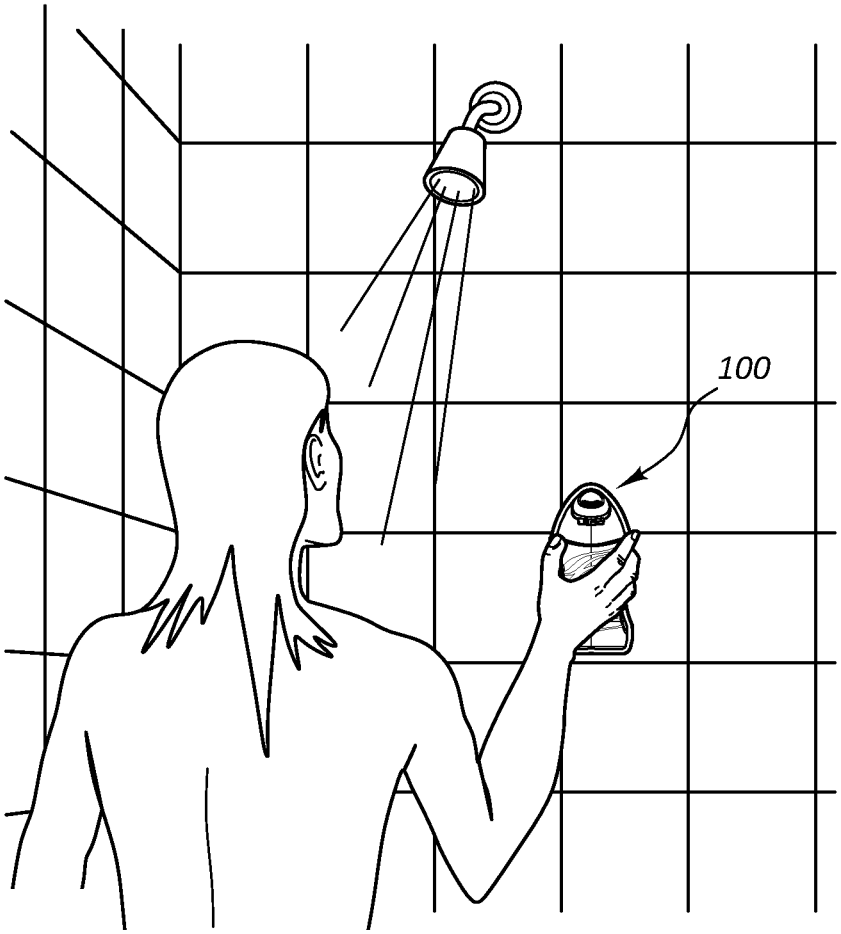

FIGS. 4A-4B illustrate how during use the direct dispensing of the liquid or gel composition onto the scrubber substrate 118 keeps the user in control of where the composition is placed, preventing or minimizing dripping or rinsing away of the composition before the surface is scrubbed clean. As shown, the device allows single handed dispensing and scrubbing operation. The substrate 118 may advantageously be attached over the device where the cleaning composition 106 is dispensed into substrate 118. Direct dispensing of composition 106 into substrate 118 significantly reduces formation of aerosolized particles of the cleaning composition, making the cleaning device more suitable for cleaning of the shower or bathtub in the flow of the shower or bath water. In addition, direct dispensing also reduces and/or eliminates overspray and allows for the user to better control which areas are being contacted and cleaned. Furthermore, direct dispensing into the substrate, rather than generation of significant aerosol is important in reducing the potential for eye irritation.

Such a cleaning method may be performed immediately before, immediately after, or during showering. For example, such cleaning may be performed after showering, before the user exits the shower, dresses, and perhaps even before drying off. Such cleaning before showering may be performed after the user has undressed and stepped into the shower, but the user may choose to clean the shower before himself or herself. In such before the shower cleaning, the shower water may typically be running, with the user in the shower. Of course, the method may also be performed in the flow of shower water, as the user showers. In any case, the user may scrub the desired surfaces, and then rinse the surface (e.g., with shower water).

In an embodiment, the volume of the metered dose dispensed upon a single actuation of the actuator 108 may be from about 0.3 cc to about 1 cc, or from about 0.4 to about 0.8 cc (e.g., about 0.6 cc). The container housing and reservoir may be sized to hold about 8 fl oz to about 12 fl. oz (e.g., about 10 fl oz) of the cleaning composition, which may be sufficient for about 500 metered doses. Such an amount may be sufficient for about 30 uses, of about 15 or 16 doses per shower cleaning use. For example, the cleaning device may be provided prefilled, ready to use, as an all-in-one cleaning tool. Such configuration may not be refillable, to be used for about 30 uses, and then disposed of (e.g., a use of once per day would last about 1 month, a use of once a week would last about 6 months, etc.).

As described above, the substrate 118 and or composition 106 may include an antimicrobial agent therein. Such may aid in sanitizing or disinfecting the surfaces being cleaned. In an embodiment, substrate 118 may include silver ions disposed therein, which silver ions provide an antimicrobial effect. Other antimicrobials may that could be provided in the substrate and/or the cleaning composition may include hypochlorite, quaternary amines, biguanides (e.g., triclosan), etc. The inclusion of such an antimicrobial agent in the substrate may allow the cleaning device to clean and sanitize or disinfect the cleaned surfaces for that period of time it is used (e.g., over a period of about 30 uses). Once all the cleaning composition has been dispensed, the cleaning device may be disposed of.

FIGS. 6-13 illustrate additional cleaning devices, which may include a squeezable container housing, and a dispensing valve configured to dispense the cleaning composition from the reservoir through the dispensing valve. Of course, any of the above described embodiments could include a squeezable container housing, if desired.

FIGS. 6-9 show an exemplary cleaning device 200 including a squeezable container housing 202 which includes a reservoir 204 for holding a cleaning composition 106. Composition 106 may be preloaded within the reservoir 204 of squeezable container housing 202, e.g., during manufacture. Cleaning composition 106 may be any of those described above, elsewhere herein, or others that will be apparent to one of skill in the art.

Cleaning device 200 may further include a dispensing valve 234. By way of example, dispensing valve 234 may be positioned within an opening 236 in the bottom wall 220 of container housing 202. The user may squeeze container housing 202, e.g., between a thumb and fingers of a user's hand, which may generate a pressure within reservoir 204 sufficient to allow cleaning composition 106 to be expressed therefrom, through dispensing valve 234. Dispensing valve may have any of a wide variety of configurations that will be apparent to one of skill in the art, in light of the present disclosure. In an embodiment, the dispensing value 234 may be a one-way valve configured to prevent backflow into the reservoir 204.

Cleaning device 200 further includes a substrate 218 (e.g., a nonwoven, woven, sponge, foam, and/or cellulose material) that may be configured as a scrubbing pad, attached to the bottom of cleaning device 200. For example, substrate 218 could be attached directly to bottom wall 220, or as shown, a sled 238 may be disposed between squeezable container 202 and substrate 218, so that substrate 218 may be attached to sled 238. In other words, substrate 218 may be indirectly attached to bottom wall 220, e.g., through sled 238.

Figure 7:
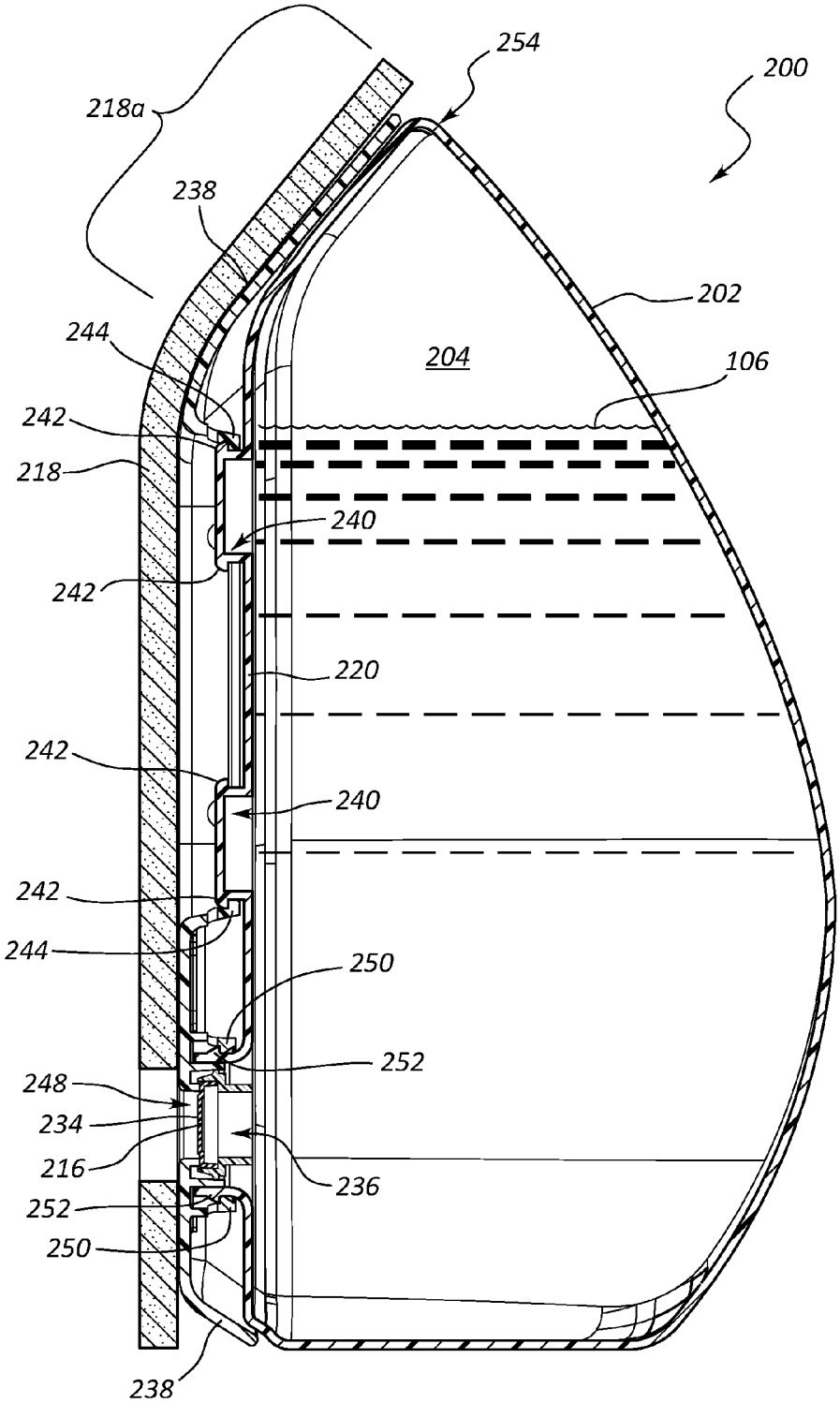
FIG. 7 is a cross-sectional view through the cleaning device of FIG. 6.
Figure 8:
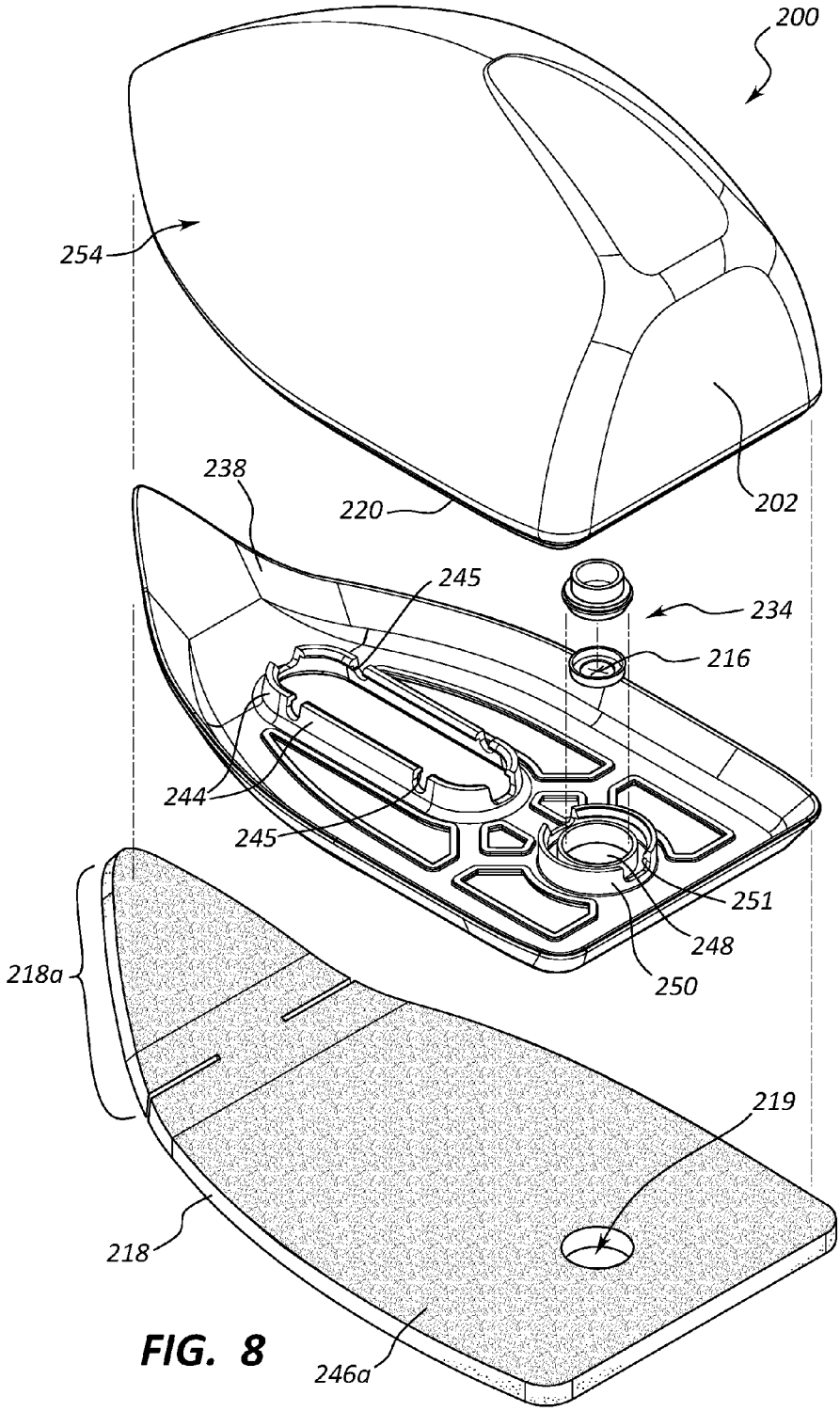
FIG. 8 is an exploded view of the cleaning device of FIG. 6.
Figure 9:
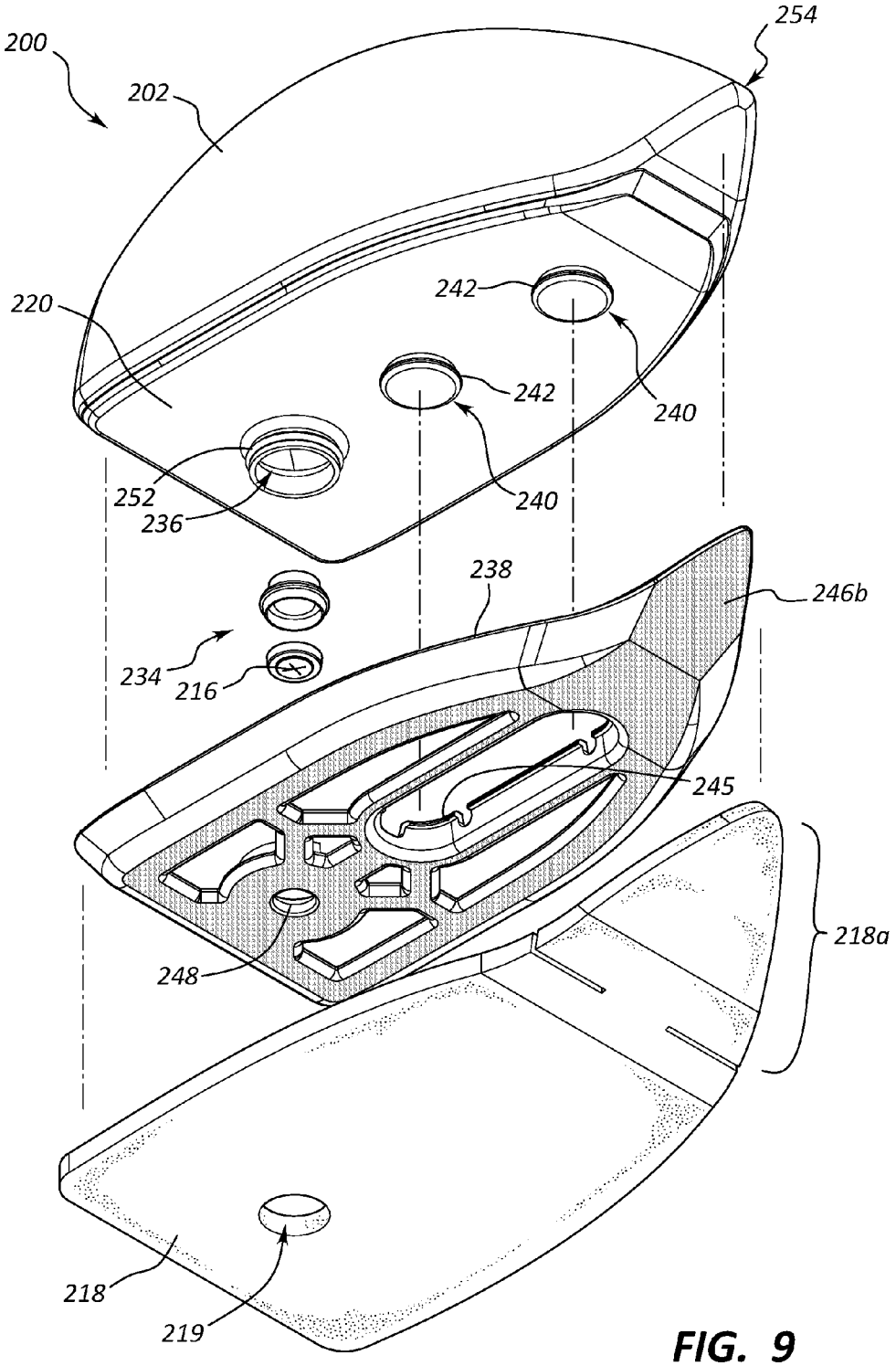
FIG. 9 is another exploded view of the cleaning device of FIG. 6.
Figure 10:
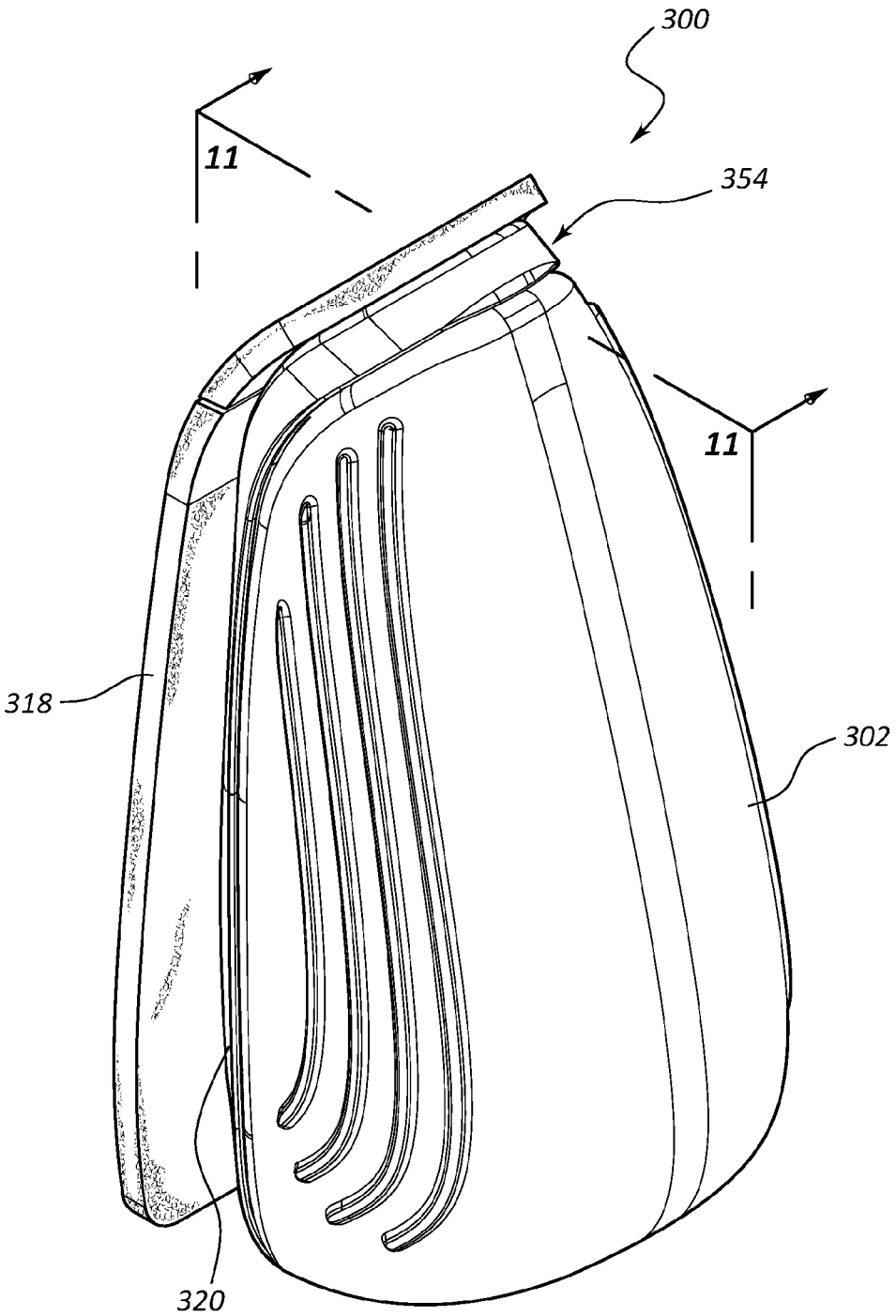
FIG. 10 is a perspective view of another exemplary cleaning device, that may include a squeezable container housing.
Figure 11:
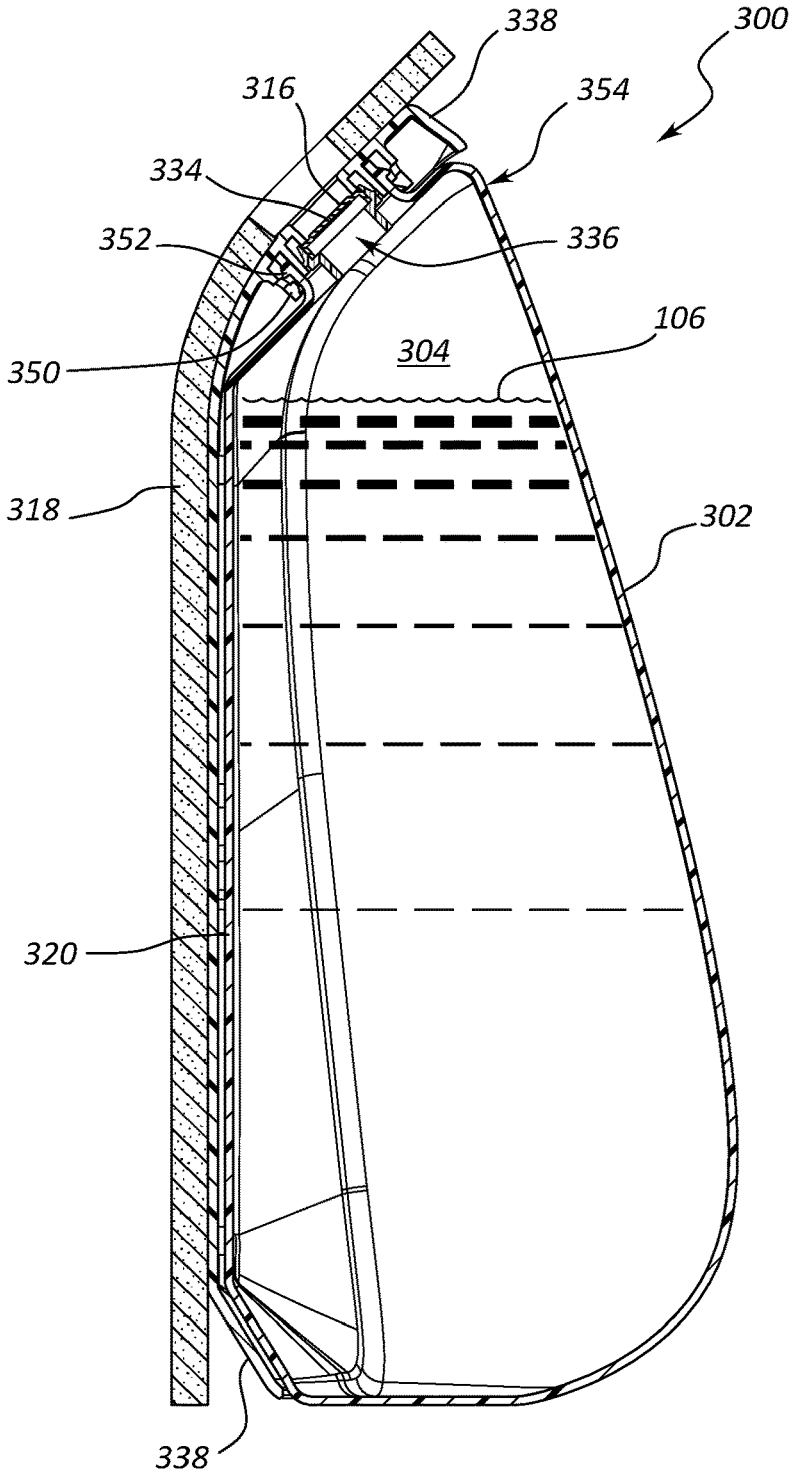
FIG. 11 is a cross-sectional view through the cleaning device of FIG. 10.
Figure 12:
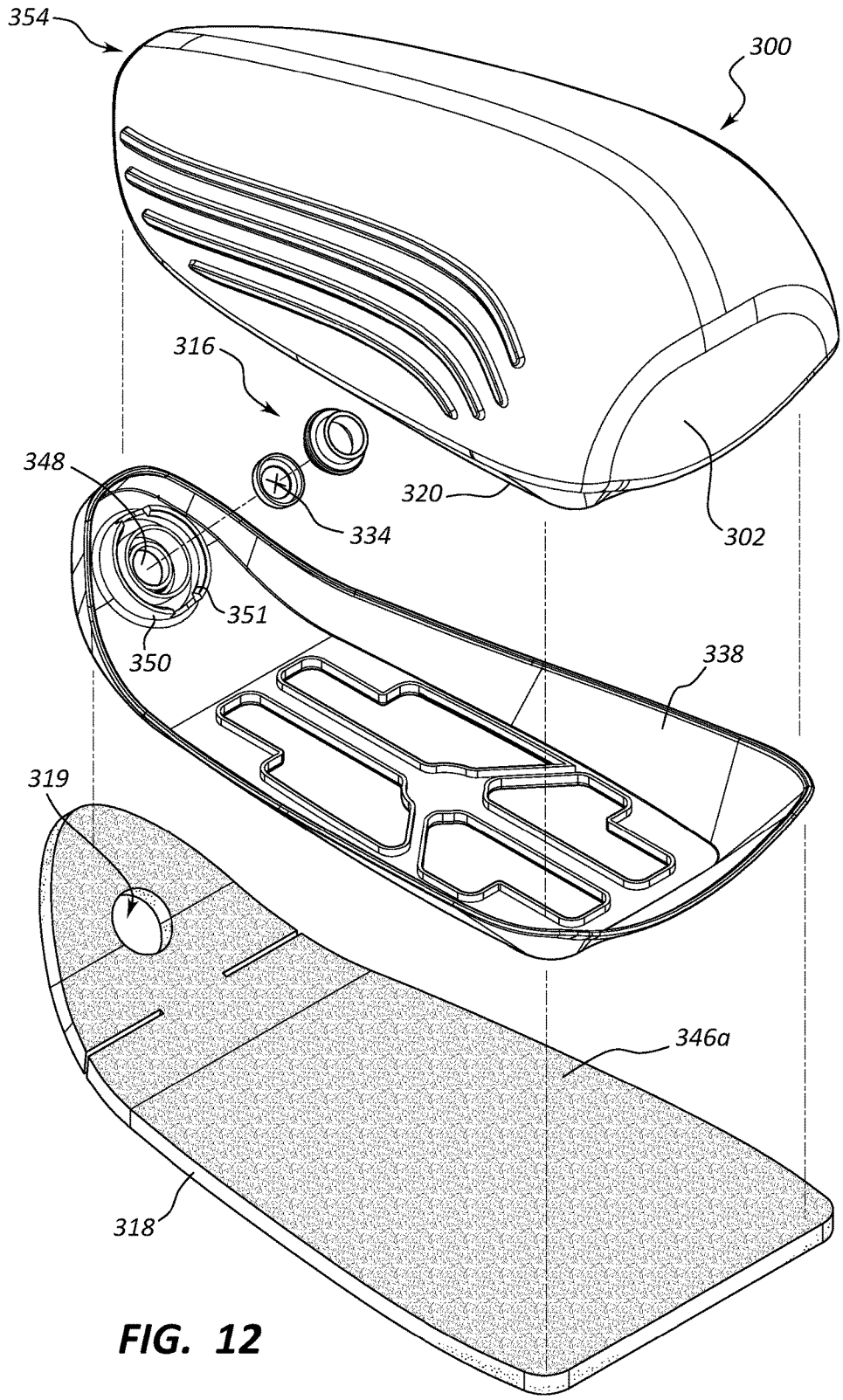
FIG. 12 is an exploded view of the cleaning device of FIG. 10.
Figure 13:
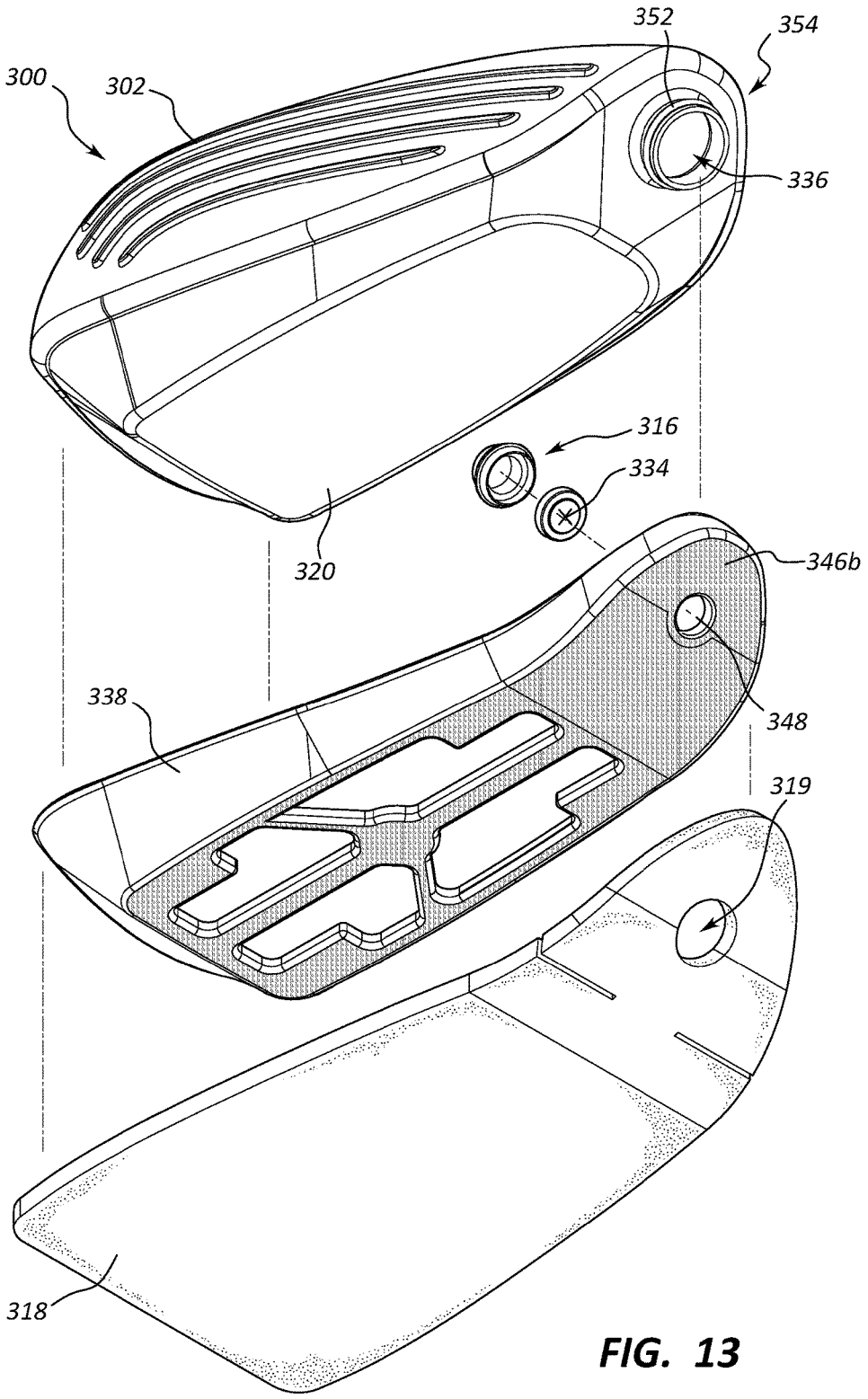
FIG. 13 is another exploded view of the cleaning device of FIG. 10.

Attachment between substrate 218 and sled 238 is perhaps best seen in the cross-sectional view of FIG. 7, and exploded views of FIGS. 8-9. Attachment of the two may be by any suitable mechanism. For example, as described herein, an adhesive exhibiting stability in high humidity environments may be used. In another embodiment, a mechanical mechanism, such as a hook and loop attachment structure may be disposed between the sled 238 and the substrate 218, attaching the two together. Other suitable attachment mechanisms could alternatively be employed. An example of how such a hook and loop attachment structure may be configured is described in further detail below, in conjunction with FIGS. 8-9.

As shown in FIG. 7, sled 238 may snap-fit onto bottom wall 220 of container body 202. Other attachments (e.g., friction fit, adhesive, or other) may alternatively or additionally be used. As shown in FIG. 9, the bottom wall 220 may include one or more protrusions extending downwardly from bottom wall 220. FIG. 9 shows two protrusions 240. Protrusions 240 are shown as including a lateral head 242 at the perimeter of protrusion 240, configured to snap-fit or otherwise engage with extension 244 of sled 238. Extension 244 is shown as extending upwardly, towards bottom wall 220 from sled 238. Extension 244 is also shown as including a rounded, oval shaped profile, with an inwardly extending lip 245, so as to mate with laterally extending heads 242 of protrusions 240. For example, lateral heads 242 snap within lip 245, coupling the two together. Such coupled mating of lip 245 of extension 244 with heads 242 is seen in FIG. 7.

As shown, sled 238 may be configured as a frame, e.g., including a perimeter portion and various internal cut-out sections, as seen in FIGS. 8-9. The bottom of at least some of such frame portions may include a hook portion or a loop portion of a hook and loop attachment structure. The perimeter, or at least a portion of the perimeter of the top surface of substrate 218 may include the hook or loop structure (designated 246*a*), while the underside of the corresponding perimeter portions of sled 238 includes the other of the hook and loop structure (designated 246*b*). It will be appreciated that the hook and loop structures could be positioned in other locations apart from the perimeter of substrate 218 and sled 238, although a perimeter (or near the perimeter, e.g., somewhat recessed from the outer edge) location may aid in more securely holding the substrate 218 to the sled 238.

It will be appreciated that depending on the particular material selected for substrate 218, substrate 218 itself may represent the loop portion of a hook and loop attachment structure. In other words, the substrate 218 itself (e.g., a non-woven, "scrubby" substrate) may adhere to the hook portion of a hook and loop attachment structure. FIGS. 8-9 show such an embodiment, where the substrate 218 itself may serve as one portion of the hook and loop attachment structure (e.g., the loop portion). As shown, the corresponding hook (or loop) on sled 238 may cover all of the bottom surface, or only select portions thereof (e.g., around a perimeter portion of sled 238).

As seen in FIG. 7, substrate 218 may include a cut-out 219 formed therein, about dispensing orifice 216 of dispensing valve 234. Sled 238 may similarly include an opening 248, which aligns with opening 236 in bottom wall 220, through which the cleaning composition 106 is dispensed. Opening 248 of sled 238 may be surrounded by a snap-fit or similar extension 250 (e.g., including a lip 251) configured to mate with a lateral head 252 extending from bottom wall 220.

Engagement between lip 251 of extension 250 and lateral head 252 may be in a similar manner as described relative to lip 245 of extension 244 snapping over lateral head 242. Extension 250 of sled 238 may thus cap over opening 236 in bottom wall 220 of squeezable container housing 202. As seen in FIG. 7, the dispensing valve 234 may be disposed within one or both of axially aligned openings 236 and 248, e.g., towards the rear of cleaning device 200. As shown, openings 236, 248, and dispensing valve 234 disposed therebetween may be axially aligned with one another.

As shown in FIGS. 6-9, cleaning device 200 may include an angled front nose 254, so that front nose 254 is reduced in width as compared to regions posterior to the angled front nose 254. This allows the front nose 254 to more easily reach into hard to reach areas being cleaned (e.g., into corners, between faucet fixtures and a wall or countertop, and the like). As seen in FIG. 7, both the sled 238 and substrate 218 may similarly be angled, with the reduced width. As perhaps best seen in FIG. 7, the bottom surface of the cleaning device 200 may be chamfered, so as to be angled upwards, to allow the chamfered bottom surface 218*a* (e.g., of substrate 218) to contact a planar surface (e.g., a wall, countertop, mirror, etc.) without the remainder of the bottom surface of the cleaning device (e.g., substrate 218) contacting a planar surface (e.g., countertop, wall, mirror, or the like) being cleaned.

Similarly, when the remainder of the bottom surface of substrate 218 contacts a planar surface being cleaned, the chamfered bottom surface 218*a* of angled nose 254 may not contact such surface, as 218*a* of angled nose 254 is in a different plane than the remainder of substrate 218. For example, this may allow a user to target a particular area (e.g., a corner) for scrubbing with just that portion of substrate 218 (e.g., portion 218*a*) covering angled nose 254. In other words, a user may choose to apply all applied scrubbing force to the small area of surface 218*a*, to more aggressively scrub a target soil, or the like.

Where a cut-out 219 is provided in substrate 218, cleaning composition 106 may be squirted clear of substrate 218 (e.g., at least where cut-out 219 is sufficiently large to prevent depositing of spray on the perimeter of substrate 218 around cut-out 219), allowing the user to spray or squirt the cleaning composition 106 directly onto the desired surface to be cleaned. Of course, such a cut-out configuration could be provided in any of the other embodiments described herein, if desired. While a cut-out 219 is shown, it will be appreciated that if desired, the substrate 218 may cover the dispensing valve, as in the embodiments shown previously, so that the cleaning composition may be squirted, sprayed, or otherwise dispensed directly into the substrate 218.

Dispensing valve 234 may be configured to require a squeezing force (or pressure in reservoir 204) above a given threshold value, before cleaning composition 106 is dispensed. For example, such a threshold (greater than 0 lbf or 0 psi) may prevent a user from inadvertently dispensing the cleaning composition while merely gripping the container housing, where dispensing of the cleaning composition was not yet intended. Those of skill in the art will appreciate where such a threshold on force (in lbf) or pressure (in psi) may appropriately be set.

FIGS. 10-13 illustrate another exemplary cleaning device 300 similar in many respects to cleaning device 200, but in which the dispensing valve 316 is disposed in the angled front nose 354 of cleaning device 300. Similar to cleaning device 200, cleaning device 300 is shown as including a squeezable container body 302 defining an internal reservoir 304 within which cleaning composition 106 may be stored (e.g., pre-filled during manufacture). A dispensing valve 316 is shown, configured to dispense cleaning composition 106 from reservoir 304 through valve 316 upon a user squeezing container body 302. A retaining ring 334 is located next to dispensing valve 316.

A sled 338 is shown attached over bottom wall 320 of container housing 302, with a substrate 318 attached to sled 338 (e.g., by a hook and loop attachment mechanism, or other suitable attachment mechanisms as described herein). Sled 338 is shown as including an opening 348, which is aligned with opening 336 in bottom wall 320 of container housing 302. Openings 348 and 336 are shown as positioned within angled front nose 354 of cleaning device 300, aligned with one another, and with dispensing valve 316 and cut-out 319. While the embodiments of cleaning devices 200 and 300 show a single dispensing valve for the cleaning device, it will be appreciated that more than one dispensing valve could be provided (e.g., each within a corresponding opening in bottom wall 220 or 320, as appropriate).

Attachment of sled 338 to bottom wall 320 may be by any suitable mechanism. Opening 348 may be bounded by a snap-fitting extension 350 and lip 351, which extends upwardly towards attachment structure (e.g., laterally extending head 352) surrounding opening 336 in bottom wall 320. Attachment of sled 338 to substrate 318 may be by a hook and loop structure (e.g., designated 346*a* and 346*b*), or by any other suitable mechanism. Cleaning device 300 allows dispensing of cleaning composition 106 through the openings 336 and 348 (through dispensing valve 316) in angled front nose 354, but is otherwise similar in many respects to cleaning device 200.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A cleaning device comprising:

(a) a squeezable container housing comprising a bottom wall and a fluid reservoir and an outlet for dispensing, wherein the fluid reservoir is configured such that a lateral depth of the fluid reservoir is at a maximum between upper and lower ends of the reservoir, and the lateral depth of the fluid reservoir gradually decreases from the maximum to the upper end of the fluid reservoir, and the lateral depth of the fluid reservoir gradually decreases from the maximum to the lower end of the fluid reservoir;

(b) a volume of a cleaning composition disposed within the fluid reservoir, wherein the cleaning composition comprises a hypochlorite;

(c) a dispensing valve disposed at or near the outlet, and in fluid communication with the reservoir, the dispensing valve being configured to dispense a cleaning composition from the reservoir through the dispensing valve when the cleaning composition is present in the reservoir and a user squeezes the container housing which subsequently opens the dispensing valve in response to a pressure increase in the reservoir;

(d) a sled having a generally planar configuration and located downstream of the dispensing valve; and (e) a substrate attached to the sled, the substrate being disposed over or about a dispensing orifice of the dispensing valve so that upon squeezing the squeezable container housing, the cleaning composition, when present in the reservoir, is dispensed from the reservoir, through the dispensing orifice.

2. The cleaning device of claim 1, wherein the sled caps an opening in the squeezable container housing at the location of the dispensing valve.

3. The cleaning device of claim 1, wherein the sled comprises a surface to which the substrate is attached.

4. The cleaning device of claim 3, wherein the substrate is attached by a hook and loop attachment structure.

5. The cleaning device of claim 1, wherein the dispensing valve is disposed in an angled front nose of the cleaning device.

6. The cleaning device of claim 1, wherein the dispensing value is a one-way valve configured to prevent backflow into the reservoir.

7. The cleaning device of claim 1, wherein the dispensing valve is disposed in the opening defined by the sled.

8. The cleaning device of claim 1, wherein the substrate comprises abrasive.

9. The cleaning device of claim 1, wherein part of the substrate is absorbent.

10. The cleaning device of claim 1, wherein a shape of the reservoir is asymmetric with respect to an axis defined by, and extending through, the outlet.

11. The cleaning device of claim 1, wherein the dispensing value is located proximate the upper end of the reservoir.

12. The cleaning device of claim 1, wherein the substrate comprises a nonwoven substrate.

13. The cleaning device of claim 1, wherein the substrate comprises bristles.

14. The cleaning device of claim 13, wherein the bristles are disposed at an angle relative to a vertical axis defined by the reservoir.

* * * * *